US007748478B2

(12) United States Patent
Swadi

(10) Patent No.: US 7,748,478 B2
(45) Date of Patent: Jul. 6, 2010

(54) PERCUSSION DRILLING ASSEMBLY AND HAMMER BIT WITH AN ADJUSTABLE CHOKE

(75) Inventor: Shantanu Swadi, Cypress, TX (US)

(73) Assignee: Smith International, Inc., Houston, TX (US)

( * ) Notice: Subject to any disclaimer, the term of this patent is extended or adjusted under 35 U.S.C. 154(b) by 76 days.

(21) Appl. No.: 12/176,755

(22) Filed: Jul. 21, 2008

(65) Prior Publication Data

US 2010/0012380 A1 Jan. 21, 2010

(51) Int. Cl.
*E21B 4/14* (2006.01)
*E21B 1/38* (2006.01)

(52) U.S. Cl. ..... 175/296; 175/293; 175/297

(58) Field of Classification Search ..... 175/293, 175/296, 297

See application file for complete search history.

(56) References Cited

U.S. PATENT DOCUMENTS

| | | | | | |
|---|---|---|---|---|---|
| 2,661,928 | A | * | 12/1953 | Topanelian, Jr. | 173/73 |
| 3,616,868 | A | * | 11/1971 | Bassinger | 175/92 |
| 4,333,537 | A | * | 6/1982 | Harris et al. | 173/17 |
| 4,923,018 | A | * | 5/1990 | Meek | 173/78 |
| 5,115,875 | A | * | 5/1992 | Ennis | 175/92 |

* cited by examiner

*Primary Examiner*—Giovanna C Wright
(74) *Attorney, Agent, or Firm*—Conley Rose, P.C.

(57) ABSTRACT

A percussion drilling assembly for drilling through earthen formations and forming a borehole. In an embodiment, the percussion drilling assembly comprises a fluid conduit including a tubular body having a first end, a second end, a through passage extending between the first end and the second end, and an inlet port in fluid communication with the through passage. In addition, the percussion drilling assembly comprises an adjustable choke at least partially disposed in the through passage and including a first bypass port. The adjustable choke is adapted to decrease the volumetric flow rate of a compressed fluid through the first bypass port.

42 Claims, 16 Drawing Sheets

PERCUSSION DRILLING ASSEMBLY AND HAMMER BIT WITH AN ADJUSTABLE CHOKE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Art

The disclosure relates generally to earth boring bits used to drill a borehole for applications including the recovery of oil, gas or minerals, mining, blast holes, water wells and construction projects. More particularly, the disclosure relates to percussion hammer drill bits. Still more particularly, the disclosure relates to percussion hammer drill bits with adjustable chokes.

2. Background of Related Art

In percussion or hammer drilling operations, a drill bit mounted to the lower end of a drill string simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone. The borehole created will have a diameter generally equal to the diameter or "gage" of the drill bit.

A typical percussion drilling assembly is connected to the lower end of a rotatable drill string and includes a downhole piston-cylinder assembly coupled to the hammer bit. The impact force is generated by the downhole piston-cylinder assembly and transferred to the hammer bit via a driver sub. During drilling operations, a pressurized or compressed fluid (e.g., compressed air) flows down the drill string to the percussion drilling assembly. A choke is provided to regulate the flow of the compressed fluid to the piston-cylinder assembly and the hammer bit. A fraction of the compressed fluid flows through a series of ports and passages to the piston-cylinder assembly, thereby actuating the reciprocal motion of the piston, and then is exhausted through a series of passages in the hammer bit body to the bit face. The remaining portion of the compressed fluid flows through the choke and into the series of passages in the hammer bit body to the bit face. The compressed fluid exiting the bit face serves to flush cuttings away from the bit face to the surface through the annulus between the drill string and the borehole sidewall.

To promote efficient penetration by the hammer bit, the bit is "indexed" to fresh earthen formations for each subsequent impact. Indexing is achieved by rotating the hammer bit a slight amount between each impact of the bit with the earth. The simultaneous rotation and impacting of the hammer bit is accomplished by rotating the drill string and incorporating longitudinal splines which key the hammer bit body to a cylindrical sleeve (commonly known as the driver sub or chuck) at the bottom of the percussion drilling assembly. The hammer bit is rotated through engagement of a series of splines on the bit and driver sub that allow axial sliding between the components but do not allow significant rotational displacement between the hammer assembly and bit.

As a result, the drill string rotation is transferred to the hammer bit itself. Rotary motion of the drill string may be powered by a rotary table typically mounted on the rig platform or top drive head mounted on the derrick.

Without indexing, the cutting structure extending from the lower face of the hammer bit may have a tendency to undesirably impact the same portion of the earth as the previous impact. Experience has demonstrated that for an eight inch hammer bit, a rotational speed of approximately 20 rpm and an impact frequency of 1600 bpm (beats per minute) typically result in relatively efficient drilling operations. This rotational speed translates to an angular displacement of approximately 5 to 10 degrees per impact of the bit against the rock formation.

The hammer bit body may be generally described as cylindrical in shape and includes a radially outer skirt surface aligned with or slightly recessed from the borehole sidewall and a bottomhole facing cutting face. The earth disintegrating action of the hammer bit is enhanced by providing a plurality of cutting elements that extend from the cutting face of the bit for engaging and breaking up the formation. The cutting elements are typically inserts formed of a superhard or ultrahard material, such as polycrystalline diamond (PCD) coated tungsten carbide and sintered tungsten carbide, that are press fit into undersized apertures in bit face. During drilling operations with the hammer bit, the borehole is formed as the impact and indexing of the drill bit, and thus cutting elements, break off chips of formation material which are continuously cleared from the bit path by pressurized air pumped downwardly through ports in the face of the bit.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutting elements upon the bit face greatly impact hammer bit durability and ROP, and thus are critical to the success of a particular bit design.

For some conventional percussion drilling assemblies, drilling efficiency and ROP decreases with drilling depth. In particular, as drilling depth increase, backpressure in the annulus that acts against the bit face increases, thereby reducing the effective force with which the hammer bit impacts the fresh formation. One conventional means to counteract the detrimental effects of increased backpressure is to increase the volume and/or pressure of the compressed fluid flowed through the percussion drilling assembly at the surface. However, in many operations, the ability to increase the volume and/or pressure of the compressed fluid is limited by the capacity of the compressors at the surface. Once the maximum capacity of the compressors is attained, additional backpressure increases detrimentally affect cutting efficiency and ROP.

In addition, while drilling through a payzone or lower pressure reservoir, it is typical for the operator to switch the drilling fluid from compressed air to nitrogen. This typically depends, at least in part, on the type and concentration of the hydrocarbon. The change to nitrogen drilling fluid primarily serves to reduce the potential for a downhole fire, which would occur in the presence of compressed air containing as much as 20% oxygen. In most cases, oxygen concentrations of 5-10% are required to stay below the flammability limit. The use of nitrogen generating units has been established as a safe and economical means of generating nitrogen to facilitate gas drilling in formations producing hydrocarbons. However, these units typically operate on the principle of membrane filtration, which limits the throughput to 50-70% depending on the level of filtration desired. As an example, a 8¾ inch diameter hammer bit using approximately 3,000 scfm of air will only have approximately 1,500 to 2,100 scfm after the changeover to nitrogen, all other factors being constant. Although it is common to have additional compressors on location to be brought on-line when the changeover occurs, it adds to significantly to the overall costs of the drilling operation.

Using the same example above, the hammer may have a choke installed, typically a ¼" diameter orifice. This choke bypasses a fraction of the compressed air on the order of a few hundred scfm. When the switchover from compressed air to nitrogen is made, the reduced volume available will lower the driving pressure and thereby result in a lower energy delivered by the hammer bit. The presence of a choke further compounds the problem, in that, even at the reduced volume available, a fraction of the volume continues to be bypassed through the choke, reducing the driving pressure even further.

Accordingly, there is a need for percussion drilling assemblies and hammer bits that offer the potential to maintain drilling efficiency and ROP under increased annulus backpressures and/or with changes in the compressed fluid. Such improved hydraulics would be particularly well received if they were adjustable during downhole drilling operations (i.e., without requiring a trip of the drill string).

SUMMARY OF SOME OF THE PREFERRED EMBODIMENTS

These and other needs in the art are addressed in one embodiment by a percussion drilling assembly for drilling through earthen formations and forming a borehole. In an embodiment, the percussion drilling assembly comprises a fluid conduit including a tubular body having a first end, a second end, a through passage extending between the first end and the second end, and an inlet port in fluid communication with the through passage. In addition, the percussion drilling assembly comprises an adjustable choke at least partially disposed in the through passage and including a first bypass port. The adjustable choke is adapted to decrease the volumetric flow rate of a compressed fluid through the first bypass port.

Theses and other needs in the art are addressed in another embodiment by a percussion drilling assembly for boring into the earth, the percussion drilling assembly coupled to the lower end of a drill string. In an embodiment, the percussion drilling assembly comprises a top sub having a through passage in fluid communication with the drill string. In addition, the percussion drilling assembly comprises a tubular casing having an upper end coupled to the top sub and a lower end coupled to a drill bit. Further, the percussion drilling assembly comprises a piston slidingly disposed in the casing, wherein the piston includes an upper end, a lower end, and through passage extending therebetween. Still further, the percussion drilling assembly comprises a fluid conduit having a central axis and a through passage. The fluid conduit extends from the through passage of the top sub to the through passage of the piston, and includes an adjustable choke that adjustably restricts fluid flow between the though passage of the fluid conduit and the through passage of the piston.

Theses and other needs in the art are addressed in another embodiment by a method for drilling an earthen borehole. In an embodiment, the method comprises disposing a percussion drilling assembly downhole on a drillstring. The percussion drilling assembly comprises a tubular casing coupled to the drillstring, a piston slidingly disposed in the casing, a first and a second chamber in the casing, and a hammer bit coupled to the casing. In addition, the method comprises flowing a compressed fluid down the drillstring from the surface. Further, the method comprises dividing the compressed fluid into a first fraction of compressed fluid having a first volumetric flow rate and that flows to the first and the second chambers, and a second fraction of compressed fluid having a second volumetric flow rate and that bypasses the first and the second chambers. Still further the method comprises decreasing the second volumetric flow rate. Moreover, the method comprises increasing the first volumetric flow rate simultaneous with decreasing the second volumetric flow rate.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
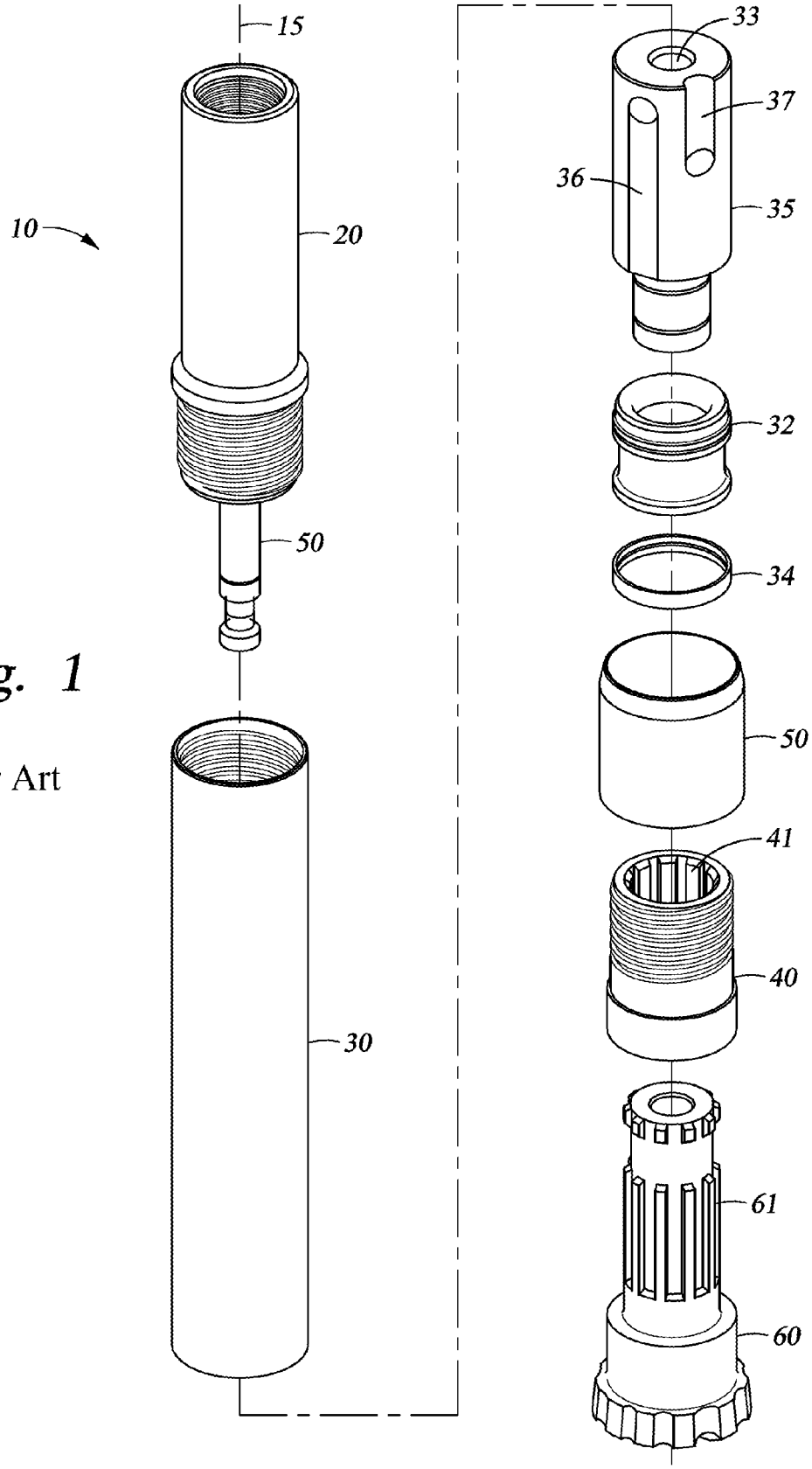
Fig. 1 Prior Art
FIG. 1 is an exploded perspective view of a conventional percussion drilling assembly including a non-adjustable choke.
Figure 2:
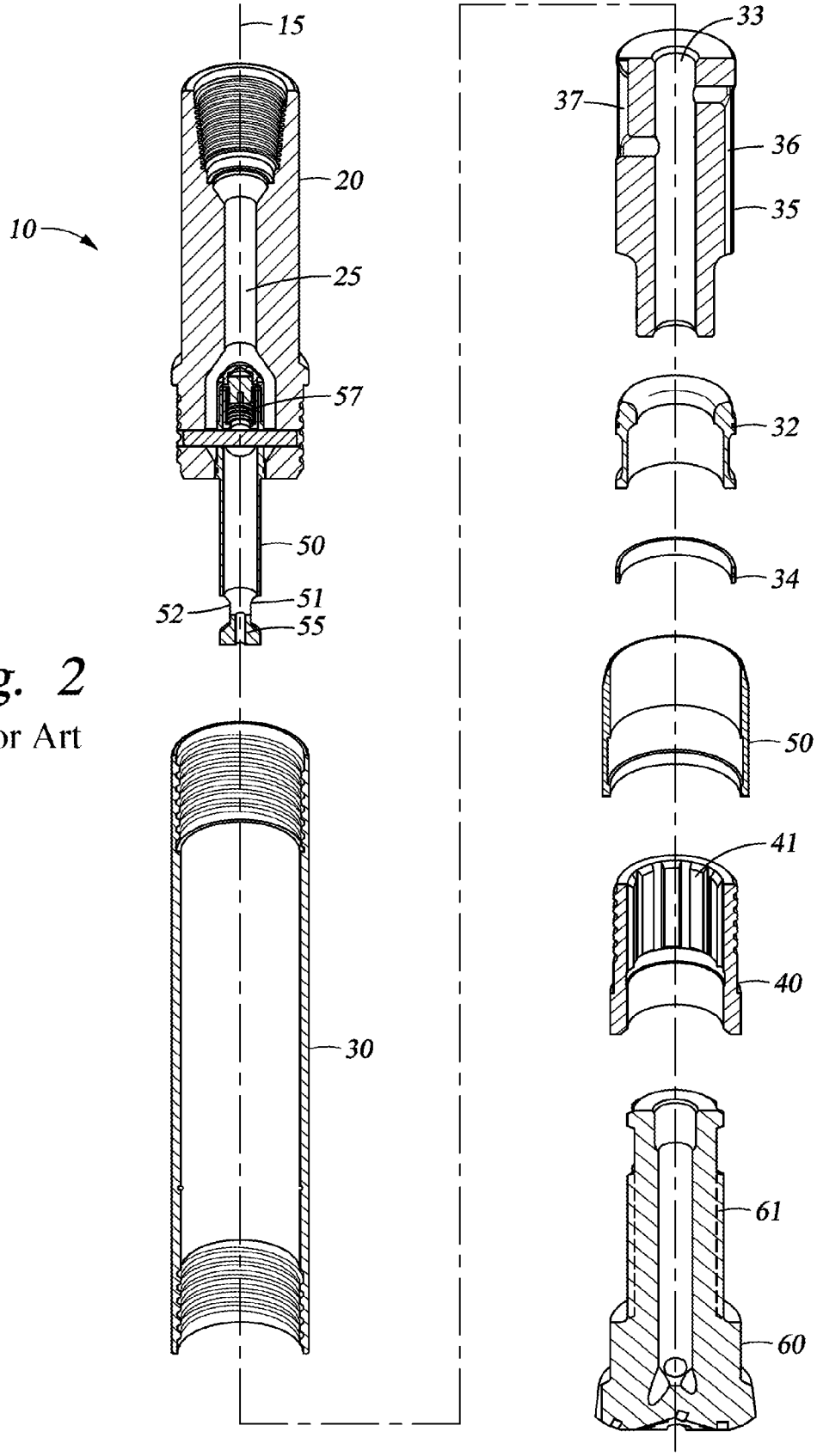
Fig. 2 Prior Art
FIG. 2 is an exploded, cross-sectional view of the percussion drilling assembly of FIG. 1.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Referring now to FIGS. 1-5, a conventional percussion drilling assembly 10 for drilling through formations of rock to form a borehole is shown. Assembly 10 is connected to the lower end of a drillstring 11 (FIGS. 3 and 4) and includes a top sub 20, a driver sub 40, a tubular case 30 axially disposed between top sub 20 and driver sub 40, a piston 35 slidably disposed in the tubular case 30, and a hammer bit 60 slidingly received by driver sub 40. A fluid conduit 50 extends between top sub 20 and piston 35. Top sub 20, case 30, piston 35, driver sub 40, fluid conduit 50, and hammer bit 60 are generally coaxially aligned, each sharing a common central or longitudinal axis 15. Similar to a typical feed tube hammer bit design, and as will be described in more detail below, compressed fluid may be flow through the inside of fluid conduit 50 and exit radially outward into ports in piston 35 to provide air to upper and lower piston-cylinder chambers that actuate piston 35. Consequently, fluid conduit 50 may also be referred to as a "feed tube". As is known in the art, percussion drilling assemblies may alternatively utilize an air distributor assembly, in which air is directed radially inward from an outer radial location into the upper and lower piston-cylinder chambers.

Figure 5:
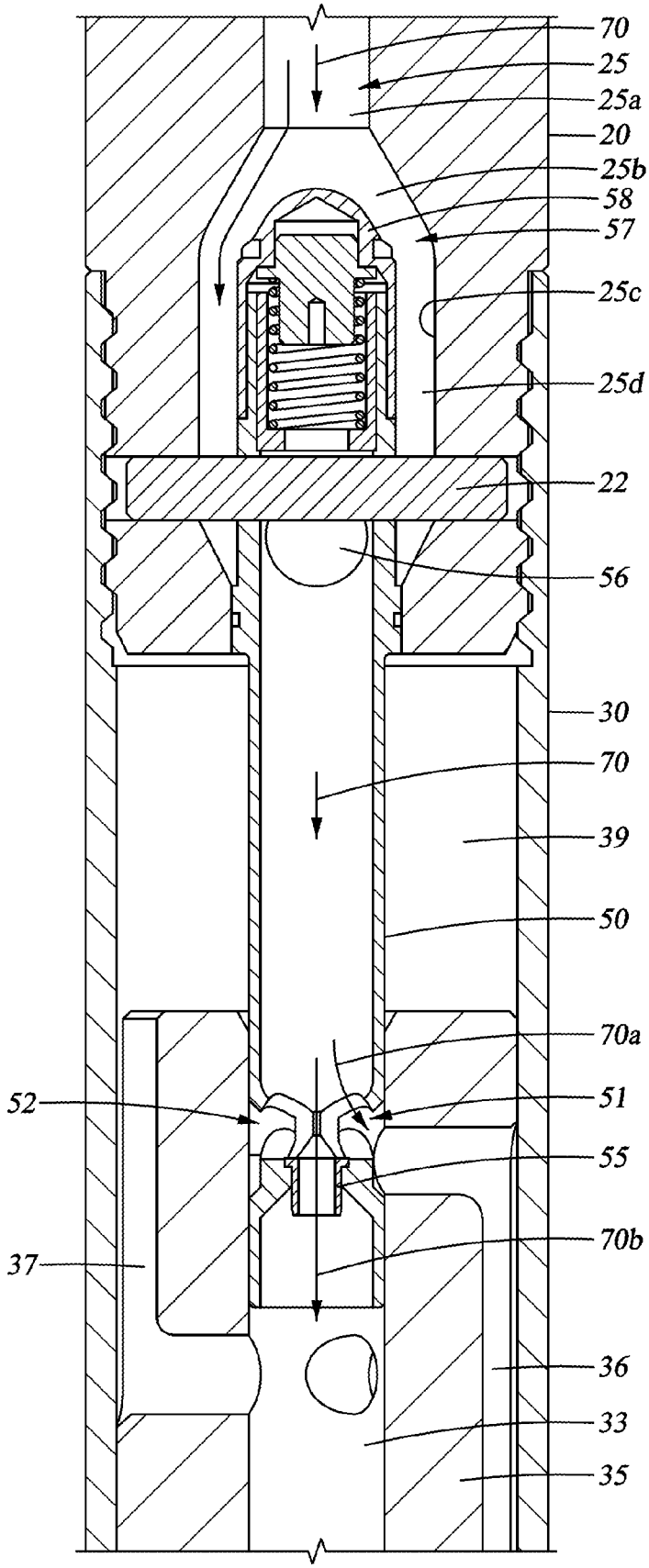
Fig. 5 Prior Art
FIG. 5 is an enlarged partial cross-sectional view of the percussion drilling assembly of FIG. 1.

The upper end of top sub 20 is threadingly coupled to the lower end of drillstring 11 (FIG. 3), and the lower end up top sub 20 is threadingly coupled to the upper end of case 30. Top sub 20 includes a central through passage 25 in fluid communication with drillstring 11. As best shown in FIG. 5, passage 25 includes a generally uniform diameter upper section 25*a*, a lower enlarged diameter section 25*c*, and a generally frustoconical transition section 25*b* extending therebetween. The upper end of fluid conduit 50 is disposed in increased diameter section 25*c*, and coupled to top sub 20 with a pin 22 extending through top sub 20 and fluid conduit 50. The outer diameter of the fluid conduit 50 is less than the diameter of section 25*c*, and thus, an annulus 25*d* is formed between fluid conduit 50 and top sub 20.

Referring specifically to FIG. 5, a check valve 57 is coupled to the upper end of feed tube 50. Check valve 57 allows one-way fluid communication between upper section 25*a* and annulus 25*d*. In particular, check valve 57 includes a closure member 58 adapted to releasably and sealingly engage top sub 20 within transition section 25*b*. Accordingly, closure member 58 and check valve 57 may be described has having a "closed position" restricting fluid communication between upper section 25*a* and annulus 25*d* (i.e., with closure member 58 engaging top sub 20 within transition section 25*b*), and an "opened position" allowing fluid communication between upper section 25*a* and annulus 25*b* (i.e., with closure member 58 axially spaced apart from the surface of transition section 25*b*). Closure member 58 is axially biased to the closed position with a spring, but transitions to the opened position when the pressure differential between section 25*a* and annulus 25*d* is sufficient to overcome the biasing force.

Referring still to FIG. 5, the upper end of feed tube 50 disposed in increased diameter portion 25*c* also includes a plurality of radial inlet ports or apertures 56 that allow fluid communication between annulus 25*d* and feed tube 50. Thus, when check valve 57 is in the opened position, drillstring 11, upper section 25*a*, annulus 25*d*, inlet ports 56, and feed tube 50 are in fluid communication. However, when check valve 57 is in the closed position, fluid communication between upper section 25*a* and annulus 25*d*, ports 56, and feed tube 50 is restricted. In this manner, check valve 57 restricts the back flow of cuttings from the wellbore into drillstring 11. The lower end of feed tube 50 includes circumferentially spaced radial outlet ports 51, 52 and an axial bypass choke 55. As used herein the term "choke" may be used to refer to a flow passage that allows the working fluid (e.g., compressed air) to bypass the working section of the percussion drilling assembly (e.g., bypass the chambers that actual piston 35). In general, the smaller the choke diameter, the less bypassed working fluid, and the greater the pressure across the piston.

Figure 3:
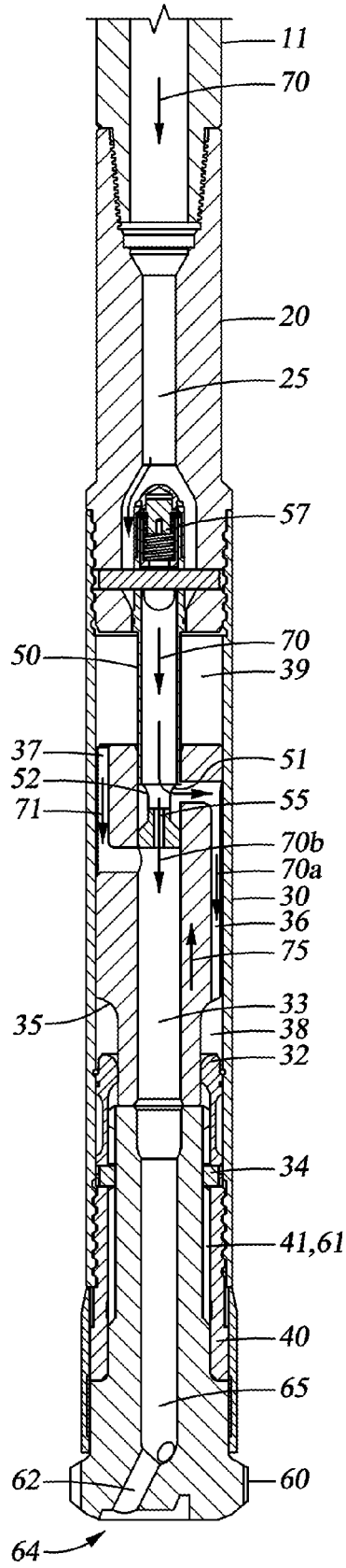
Fig. 3 Prior Art
FIG. 3 is a cross-sectional view of the percussion drilling assembly of FIG. 1 connected to the lower end of a drillstring and with the piston in its lowermost position.
Figure 4:
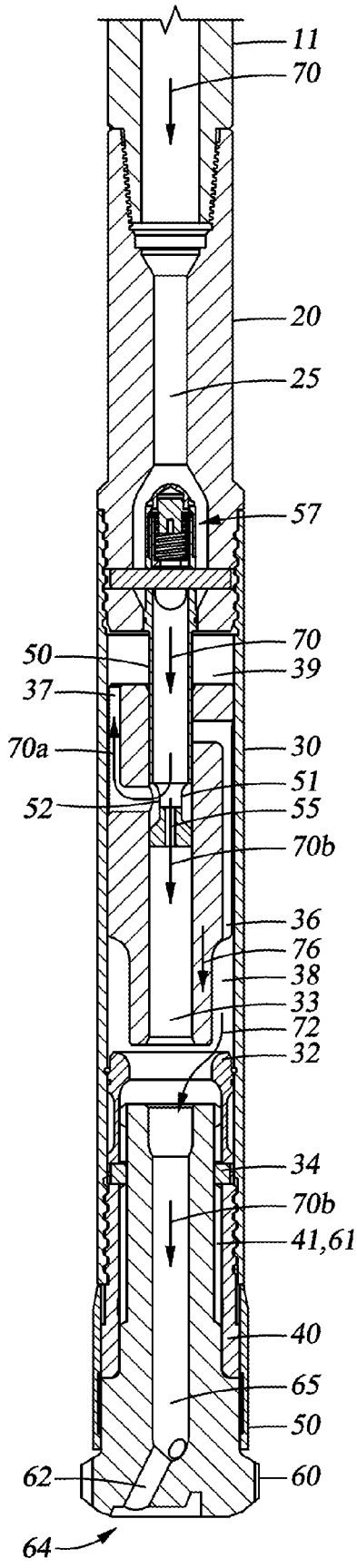
Fig. 4 Prior Art
FIG. 4 is a cross-sectional view of the percussion drilling assembly of FIG. 1 connected to the lower end of a drillstring and with the piston in its uppermost position.

Referring now to FIGS. 3 and 4, the lower end of case 30 is threadingly coupled to the upper end of driver sub 40. Piston 35 is slidingly disposed in case 30 above hammer bit 60 and cyclically impacts hammer bit 60 as will be described in more detail below. The central through passage 33 in piston 35 slidingly receives the lower end of feed tube 50. Piston 35 also includes a first set of flow passage 36 extending from central passage 33 to a lower chamber 38, and a second set of flow passage 37 extending from central passage 33 to an upper chamber 39. Lower chamber 38 is defined by case 30, the lower end of piston 35, and guide sleeve 32, and upper chamber 39 is defined by case 30, the upper end of piston 35, and the lower end of top sub 20.

During drilling operations, piston 35 is reciprocally actuated within case 30 by alternating the flow of the compressed fluid (e.g., pressurized air) between passage 36, 37 and chambers 38, 39, respectively. More specifically, piston 35 has a first axial position with outlet port 51 outlet port 51 is axially aligned with passage 36, thereby placing first outlet port 51 in fluid communication with passage 36 and chamber 38, and a second axial position with second outlet port 52 axially aligned passage 37, thereby placing second outlet port 52 in fluid communication with passage 37 and chamber 39. As the intersection of passages 33, 36 is axially spaced from the intersection of passages 33, 37, and thus, when first outlet port 51 is aligned with passage 36, second outlet port 52 is not aligned with passage 37 and vice versa. It should be appreciated that piston 35 assumes a plurality of axial positions between the first position and the second position, each allowing varying degrees of fluid communication between ports 51, 52 and passage 36, 37, respectively.

Guide sleeve 32 and a bit retainer ring 34 are also positioned in case 30 axially above driver sub 40. Guide sleeve 32 slidingly receives the lower end of piston 35. Bit retainer ring 34 is disposed about the upper end of hammer bit 60 and prevents hammer bit 60 from completely disengaging assembly 10.

Hammer bit 60 slideably engages driver sub 40. A series of generally axial mating splines 61, 41 on bit 100 and driver sub 40, respectively, allow bit 60 to move axially relative to driver sub 40 while simultaneously allowing driver sub 40 to rotate bit 60 with drillstring 11 and case 30. A retainer sleeve 50 is coupled to driver sub 40 and extends along the outer periphery of hammer bit 60. As described in U.S. Pat. No. 5,065,827, which is hereby incorporated herein by reference in its entirety, the retainer sleeve 50 generally provides a secondary catch mechanism that allows the lower enlarged head of hammer bit 60 to be extracted from the wellbore in the event of a breakage of the enlarged bit head.

In addition, hammer bit 60 includes a central longitudinal passage 65 in fluid communication with downwardly extending passages 62 having ports or nozzles 64 formed in the face of hammer bit 60. Bit passage 65 is also in fluid communication with piston passage 33. Guide sleeve 32 maintains fluid communication between bores 33, 65 as piston 35 moves axially upward relative to hammer bit 60. Compressed fluid exhausted from chambers 38, 39 into piston passage 33 of piston 45 flows through bit passages 65, 62 and out ports or nozzles 64. Together, passages 62 and nozzles 64 serve to distribute compressed fluid around the face of bit 60 to flush away formation cuttings during drilling and to remove heat from bit 60.

Referring now to FIGS. 3-5, during drilling operations, a compressed fluid (e.g., compressed air, compressed nitrogen, etc.) is delivered down the drill string 11 from the surface in the direction of arrow 70. In most cases, the compressed fluid is provided by one or more compressors at the surface. The compressed fluid flows down drill string 11 into upper section 25*a* of passage 25. With a sufficient pressure differential across check valve 57, closure member 58 will remain in the opened position allowing the compressed fluid to flow through annulus 25*d*, inlet ports 56, and down feed tube 50 to outlet ports 51, 52 and choke 55. The flow of compressed fluid is divided between ports 51, 52 and choke 55; a first fraction of the compressed fluid flows radially outward through ports 51 and/or 52 as represented by arrow 70*a*, and a second fraction of the compressed fluid flows through choke 55 into a central piston passage 33 as represented by arrow 70*b*. In general, the first fraction of the compressed fluid flowing through outlet ports 51, 52 serves to cyclically actuate piston 35, whereas the second fraction of the compressed fluid flowing through choke 55 flows through passages 33, 65, 62 and exits hammer bit 60 via ports 64, thereby flushing cutting from the face of bit 60. Since the flow of compressed fluid through outlet ports 51, 52 actuates piston 35, outlet ports 51, 52 may also be referred to as "piston actuation" ports.

Referring specifically to FIG. 3, when piston 35 is in first or lowermost position engaging the upper end of hammer bit 60, first port 51 is in fluid communication with flow passage 36 and lower chamber 38, while flow passage 37 and upper chamber 39 are in fluid communication with central piston passage 33. Thus, the first fraction of compressed fluid represented by arrow 70*a* in FIG. 3 flows through port 51 and flow passage 36 to lower chamber 38. As a result, the pressure in lower chamber 38 increases until it is sufficient to move piston 35 axially upward in the direction of arrow 75. As piston 35 moves axially upward within case 30, the volume of upper chamber 39 decreases and the pressure in upper chamber 39 initially increases. However, the fluid pressure in chamber 39 is relieved by exhausting fluid in chamber 39 through passage 37 to central piston passage 33 as represented by arrow 71. The exhausted fluid flows through passages 33, 65, 62, and exits hammer bit 60 via ports 64. As piston 35 continues to moves axially upward, first port 51 eventually moves out of alignment with flow passage 36, and thus, the first fraction of the compressed fluid is no longer provided to lower chamber 38.

Referring specifically to FIG. 4, as first port 51 moves out of alignment with flow passage 36, second port 52 moves into alignment with flow passage 37, and the lower end of piston 35 is axially spaced apart from the upper end of guide sleeve 32. The first fraction of the compressed fluid represented by arrow 70*a* in FIG. 4 flows through second port 52 to passage 37 into upper chamber 39, thereby retarding the continued upward travel of piston 35. Piston 35 achieves the second or uppermost position at the point it ceases its upward movement.

Still referring to FIG. 4, when piston 35 assumes the second position, the first fraction of the compressed fluid represented by arrow 70*a* flows through second port 52 and flow passage 37 to upper chamber 39. Pressure in upper chamber 39 increases until it is sufficient to move piston 35 axially downward. As piston 35 moves axially downward within case 30 in the direction of arrow 76, the volume of lower chamber 38 decreases and the pressure in lower chamber 38 initially increases. However, since the lower end of piston 35 is axially spaced from guide sleeve 32, the fluid in lower chamber 38 is exhausted directly to passages 65, 62 as represented by arrow 72, and exits hammer bit 60 via ports 64. As piston 35 moves axially downward, second port 52 eventually moves out of alignment with flow passage 37, and thus, the first fraction of the compressed fluid is no longer provided to upper chamber 39. Shortly thereafter, the lower end of piston 35 impacts the upper end of hammer bit 60, and first port 51 moves into alignment with flow passage 36, marking the transition of piston 35 to its lower most or first position shown in FIG. 3. This cycle repeats to deliver repetitive high energy blows to hammer bit 60. It should be appreciated that as the volume of chambers 38, 39 decreases, and the fluid in chambers 38, 39, respectively, are exhausted to bit passage 65 through central passage 33 and bypass choke 55.

As previously described, the first fraction of the compressed fluid that flows through ports 51, 52, passage 36, 37, and into chamber 38, 39, respectively, cyclically actuates piston 35 between the first position shown in FIG. 3 and the second position shown in FIG. 4. However, the second fraction of the compressed fluid that flows through choke 55 bypasses passages 36, 37 and chambers 38, 39, respectively, and therefore, does not contribute to the actuation of piston 35. During downhole drilling operations, the predetermined diameter of choke 55 is effectively fixed. Further, no mechanism is provided in conventional percussion drilling assembly 10 to increase or decrease the volumetric flow rate of the second fraction of compressed fluid flowing through choke 55 for a given volumetric flow rate of compressed fluid down drillstring 11. Accordingly, choke 55 shown in conventional percussion drilling assembly 10 may also be referred to herein as a "non-adjustable" choke. As used herein, the term "non-adjustable" may be used to refer to a choke that cannot be modified or adjusted during downhole drilling operations to alter the flow of compressed fluid therethrough.

It should also be appreciated that during drilling operations, drill string 11 and drilling assembly 10 are rotated. Mating splines 161, 41 on bit 100 and driver sub 40, respectively, allow bit 100 to move axially relative to driver sub 40 while simultaneously allowing driver sub 40 to rotate bit 100 with drillstring 11. The rotation of hammer bit 60 allows the cutting elements (not shown) of bit 100 to be "indexed" to fresh rock formations during each impact of bit 100, thereby improving the efficiency of the drilling operation.

Without being limited by this or any particular theory, the frequency of actuation of the piston (and hence the frequency with which the piston impacts the hammer bit), and the impact forces exerted on the hammer bit depend, at least in part, on the pressure and volumetric flow rate of the compressed fluid delivered to the piston-cylinder chambers (e.g., chambers 38, 39). Without being limited by this or any particular theory, for a given pressure, an increase in the volumetric flow rate delivered into the piston-cylinder chambers will result in an increase in the driving pressure which in turn will result in an increase in the frequency with which the piston impacts the hammer bit and an increase in the impact forces exerted on the hammer bit. Further, for a given volumetric flow rate, an increase in the pressure of the compressed fluid delivered to the piston-cylinder chambers will result in an increase in the frequency with which the piston impacts the hammer bit (e.g., hammer bit 60) and an increase in the impact forces exerted on the hammer bit.

Under some drilling conditions, it may be desirable to adjust the volumetric flow rate of the compressed fluid to the piston-cylinder chambers and/or adjust the pressure of the compressed fluid to the piston-cylinder chambers to alter the frequency with which the piston impacts the hammer bit and the impact forces exerted on the hammer bit. For instance, in relatively long deep drilling intervals using the same bit, as the depth increases, an increase in the volumetric flow rate and/or pressure of the compressed fluid to the piston-cylinder chambers may be desirable to overcome relatively high annulus backpressures. Conventionally, the volumetric flow rate and pressure of the compressed fluid is adjusted during drilling via air packages (e.g., adding or removing compressors at the surface, increase or decreasing the output of the compressors at the surface, etc.). However, once the maximum operating pressure and flow rate of the compressors have been reached, this option is no longer available. Consequently, in most conventional percussion drilling operations, the operator's ability to increase the volumetric flow rate to the piston-cylinder chambers is limited by the finite capacity of the compressors at the surface. However, embodiments described below offer the potential for continued increases in the volumetric flow rate of the compressed fluid to the piston-cylinder chambers even after the compressors at the surface reach their operating limits (e.g., maximum pressure and maximum flow rate). More specifically, as will be described in more detail below, embodiments described herein offer the potential to increase the volumetric flow rate of the compressed fluid to the piston-cylinder chambers during downhole drilling operations by decreasing the volumetric flow rate of the compressed fluid that is permitted to bypasses the piston-cylinder chambers via an adjustable choke. As used herein, the term "adjustable" may be used to refer to a choke that can be manipulated during drilling operations to reduce volumetric flow rate therethrough.

Figure 6:
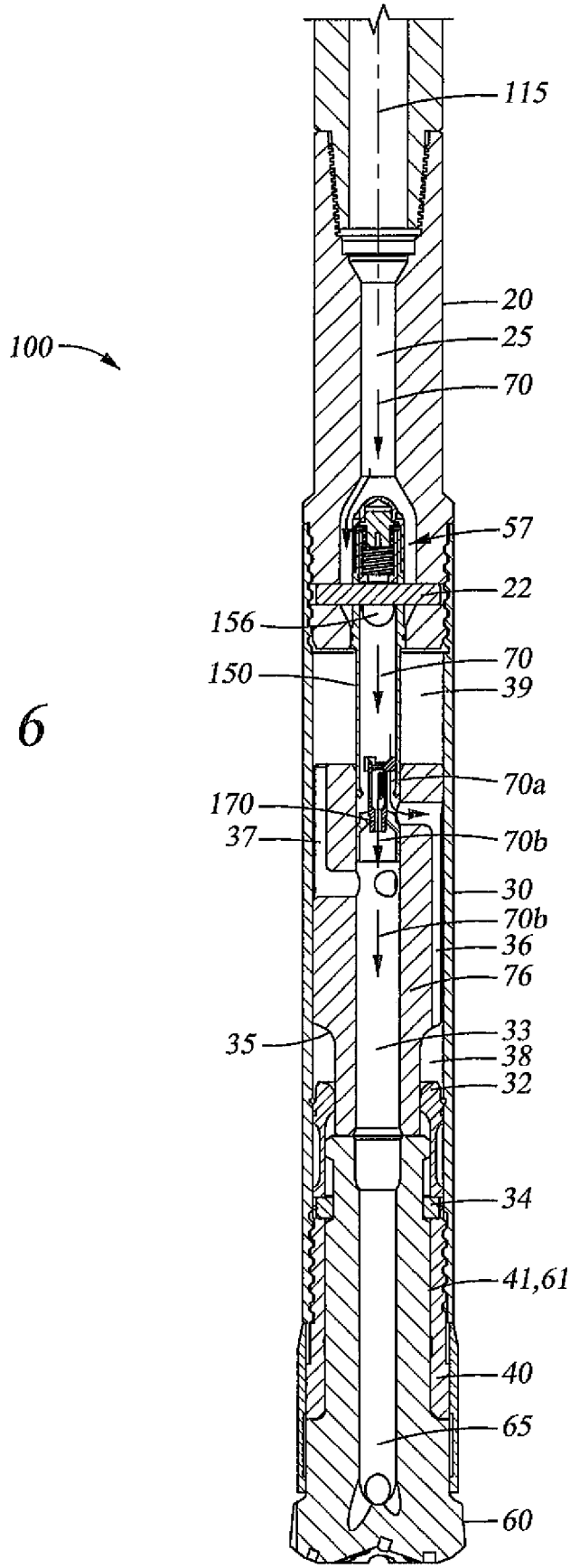
FIG. 6 is a cross-sectional view of an embodiment of a percussion drilling assembly including an adjustable choke.
Figure 7:
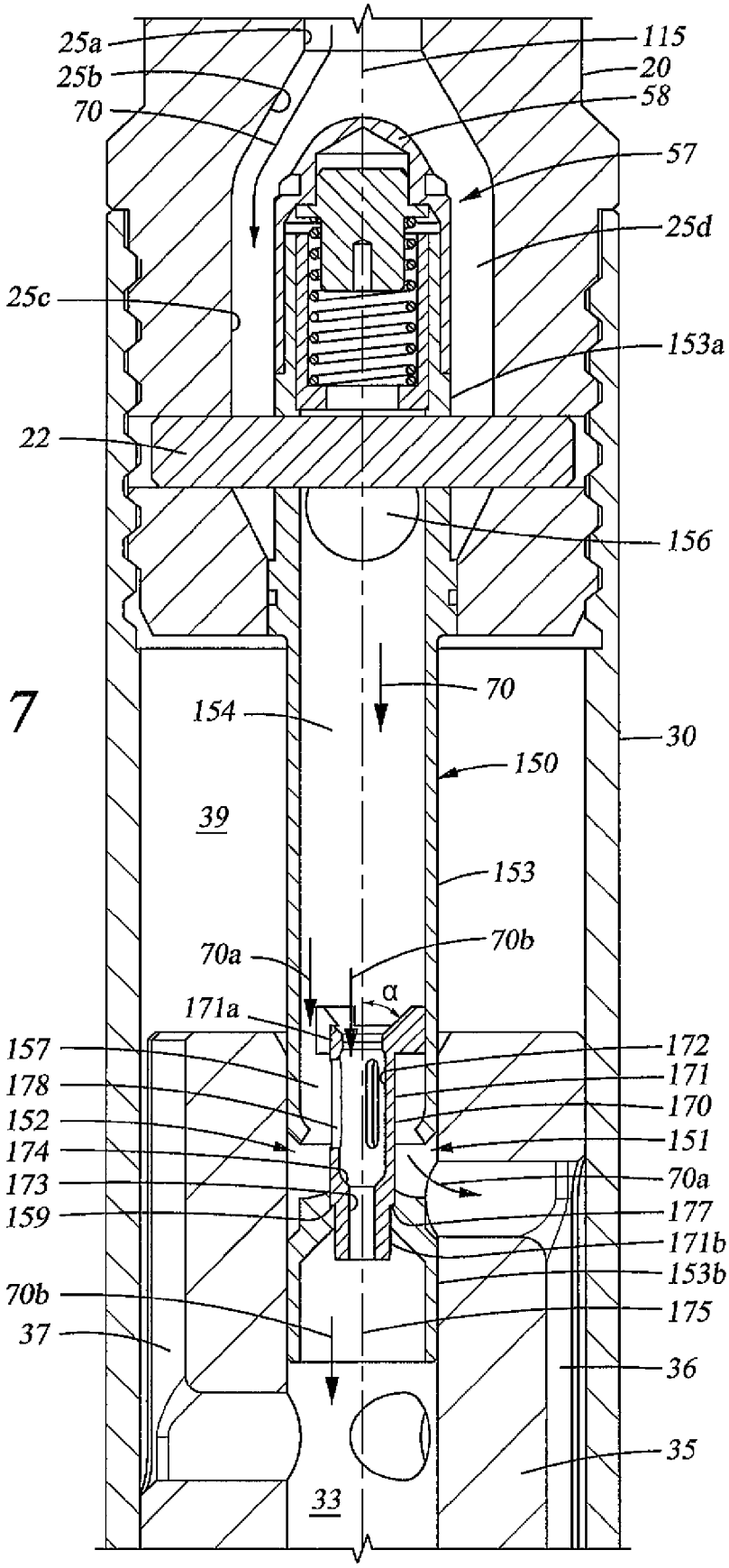
FIG. 7 is an enlarged cross-sectional view of the adjustable choke of FIG. 6 in the opened configuration.
Figure 8:
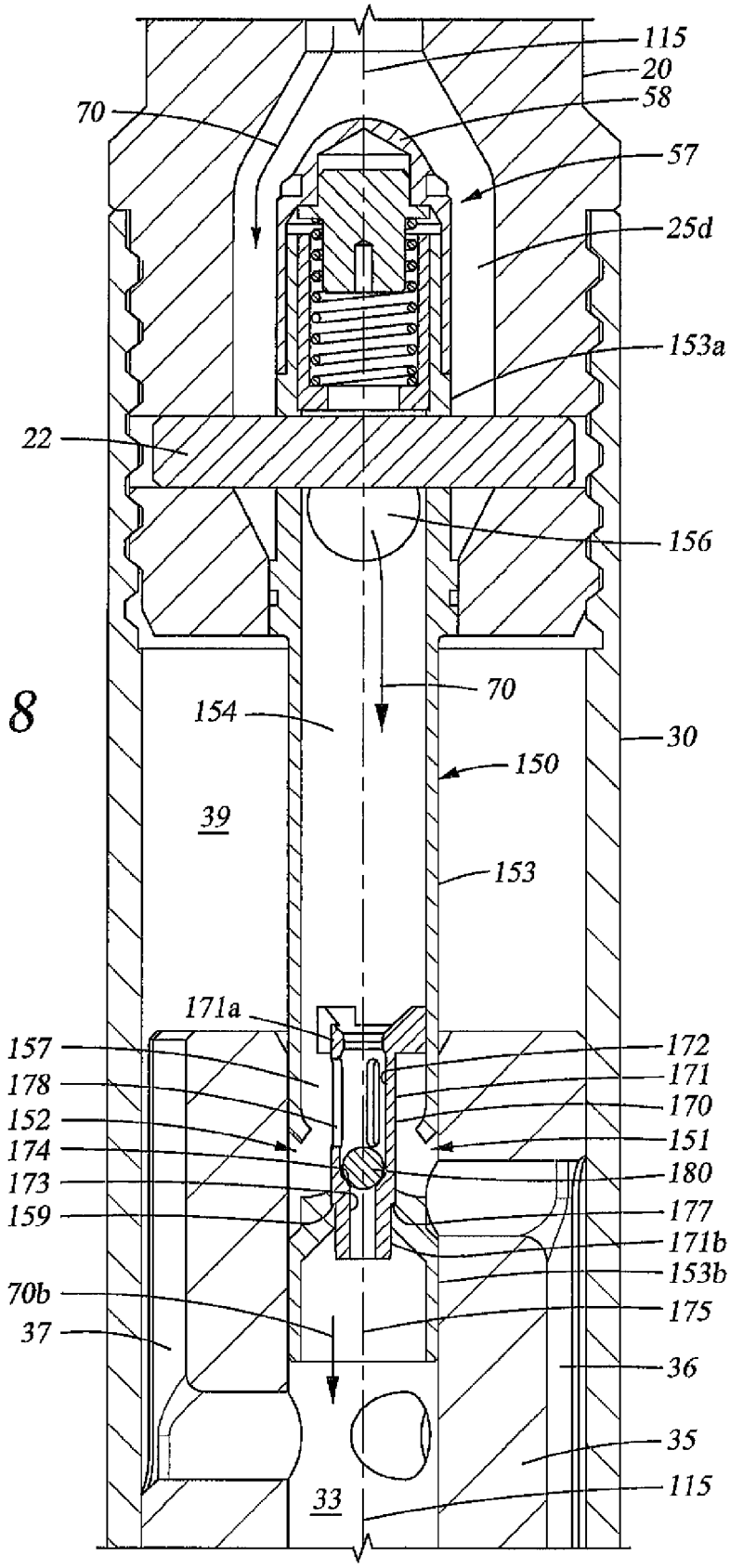
FIG. 8 is an enlarged cross-sectional view of the adjustable choke of FIG. 6 in the closed configuration.
Figure 9A:
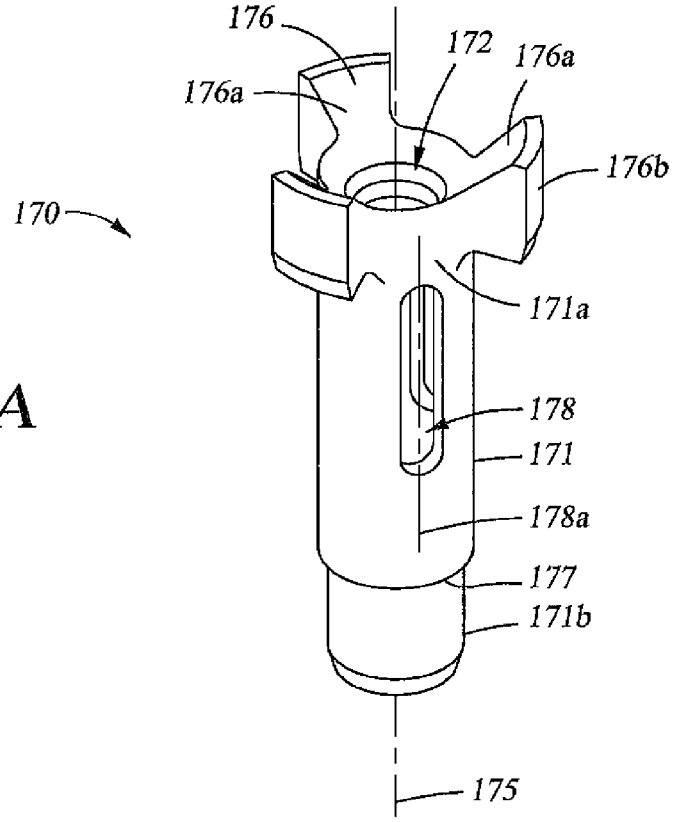
FIGS. 9*a* and 9*b* are perspective views of the adjustable choke of FIG. 6-8.
Figure 9B:
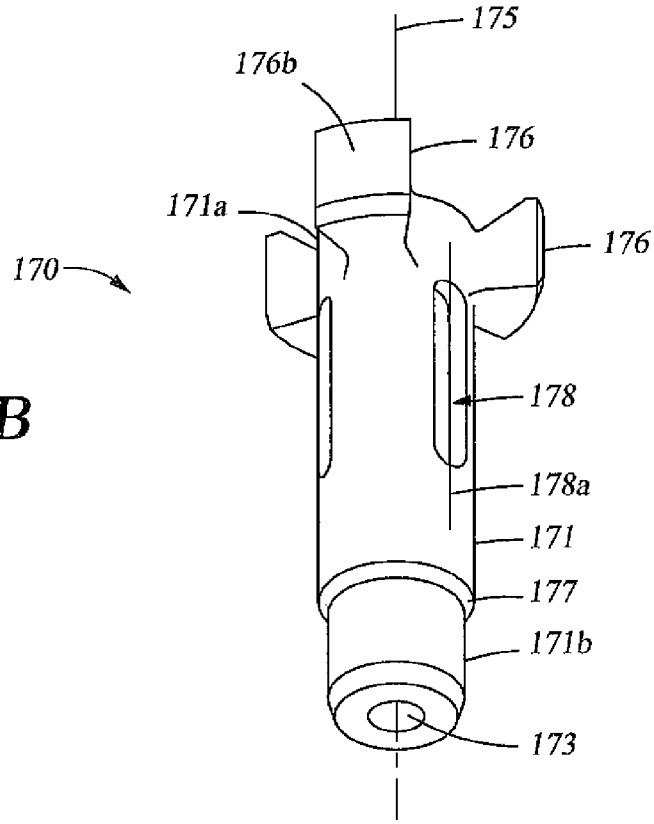

Referring now to FIG. 6-8, an embodiment of a percussion drilling assembly 100 including an adjustable choke 170 is shown. Percussion drilling assembly 100 is similar to percussion drilling assembly 10 previously described, except that assembly 100 includes a fluid conduit 150 with adjustable choke 170 in the place of feed tube 50 with conventional non-adjustable choke 55. Namely, assembly 100 is connected to the lower end of a drillstring (not shown) and includes a top sub 20, a driver sub 40, a tubular case 30, a piston 35, and a hammer bit 60 as previously described. Fluid conduit 150 extends between top sub 20 and piston 35. Top sub 20, case 30, piston 35, driver sub 40, fluid conduit 150, and hammer bit 60 are generally coaxially aligned, each sharing a common central axis 115.

Referring specifically to FIGS. 7 and 8, fluid conduit 150 includes a tubular body 153 and adjustable choke 170 coaxially disposed within body 153. Although fluid conduit 150 and choke 170 are shown and described as separate components that are coupled together, in other embodiments, the choke (e.g., choke 170) may be integral with the fluid conduit (e.g., fluid conduit 150). Tubular body 153 has an upper or inlet end 153*a*, a lower or outlet end 153*b*, and a central through passage 154 extending therebetween. Inlet end 153*a* includes a plurality of radial inlet ports or apertures 156 providing fluid communication between annulus 25*d* and passage 154. A check valve 57 as previously described is partially received by inlet end 153*a*, and allows one-way fluid communication from upper section 25*a* of passage 25 to inlet ports 156 and through passage 154. In general, check valve 57 may be coupled to body 110 by any suitable means including, without limitation, interference fit, mating threads, welded connection, fastener(s), or combinations thereof.

Referring still to FIGS. 7 and 8, lower end 153*b* includes a first radial outlet port or aperture 151, a second radial outlet port or aperture 152 circumferentially spaced from first port 151, and an annular shoulder 159 extending radially inward. As will be explained in more detail below, during drilling operations, first outlet port 151 and second outlet port 152 are alternatingly placed in fluid communication with flow passage 36 and flow passage 37, respectively, and chambers 38, 39, respectively, thereby reciprocally actuating piston 35. Accordingly, outlet ports 151, 152 may also be referred to as "piston actuation" ports.

Referring now to FIGS. 7-9*b*, adjustable choke 170 is coaxially disposed in passage 154 proximal lower end 153*b*. Adjustable choke 170 has a central axis 175 aligned with axis 115, and comprises a generally cylindrical body 171 and a plurality of radially extending arms 176. In particular, body 171 has an upper end 171*a*, a lower end 171*b*, a counterbore 172 extending axially from upper end 171*a*, and a bore or port 173 extending axially from counterbore 172 to lower end 171*b*. As will be explained in more detail below, compressed fluid flow through port 173 effectively bypasses passages 36, 37 and chambers 38, 39, and therefore does not contribute to the actuation of piston 35. Consequently, port 173 may also be referred to as a bypass port. The size or diameter of the port 173 is dependent, at least in part, on amount of the fluid volume to be bypassed, which depends upon the total available fluid volume. Operating conditions such as depth, bottomhole annulus or back pressure also are factored in to control the bypass fraction of fluid volume.

Bypass port 173 has a diameter that is less than the diameter of counterbore 172. An annular spherical seat 174 configured to receive a plug or ball 180 is formed at the intersection of counterbore 172 and bypass port 173. As best shown in FIG. 8, when plug 180 is sufficiently seated in seat 174, it restricts and/or shuts off the flow of fluids from passage 154 to piston passage 33 through reduced diameter bypass port 173. Accordingly, choke 170 may be described as having an "opened" position or configuration permitting the flow of compressed fluid through bypass port 173 to piston passage 33 (i.e., no plug disposed in seat 174), and a "closed" position or configuration in which the flow of compressed fluid through bypass port 173 is restricted and/or shut off (i.e., plug 180 seated in seat 174). In general, the plug (e.g., plug 180) may be made from any suitable material(s) including, without limitation, metal or metal alloys, polymer, composite, rubber, or combinations thereof. The plug preferably comprises a material with sufficient strength to resist extrusion through the bypass port (e.g., bypass port 173).

Choke 170 also includes an annular step or shoulder 177 disposed on the outer surface of body 171 proximal lower end 171*b*. Annular shoulder 177 engages mating shoulder mates with shoulder 159 of fluid conduit 150. During manufacturing, choke 170 is coaxially disposed in passage 154 at upper end 153*a* and axially advanced to lower end 153*b* until shoulders 177, 159 abut one another. Once choke 170 is sufficiently positioned in lower end 153*b*, check valve 57 may be axially coupled to upper end 153*a*.

Referring still to FIGS. 7-9*b*, arms 176 extend radially from upper end 171*a* of body 171 and radially space body 171 from the inner surface of fluid conduit 150. As a result, an annulus 157 is formed between choke body 171 and flow conduit 150 generally upstream of bypass port 173. In this embodiment, three arms 176 are uniformly angularly spaced about 120° apart. Although arms 176 engage flow conduit 150, fluid communication is permitted axially across arms 176 through the spaces or voids formed circumferentially between each pair of adjacent arms 176. The spaces or voids are flow conduits sized so that plug 180 is not permitted to flow or extrude therethrough. This arrangement prevents plug 180 from inadvertently entering and restricting flow through ports 151, 152. In this embodiment, arms 176 are integral with choke body 171.

Each arm 176 includes an upper guide surface 176*a* and a radially outer surface 176*b*. Outer surface 176*b* of each arm 176 engages the inner surface of feed tube body 153. Upper guide surfaces 176*a* slope downward from the inner surface of fluid conduit 150 towards bore 172, thereby functioning to guide or funnel plug 180 into counterbore 172. In this embodiment, each upper surface 176*a* is oriented at an acute angle $\alpha$ relative to central axis 115. Angle $\alpha$ is preferably between 0° and 90°, and more preferably between about 30° and 60°. As shown in FIGS. 7-9B, angle $\alpha$ is about 45°.

Referring still to FIGS. 7-9*b*, choke body 171 also includes a plurality of circumferentially spaced elongate outlet ports or apertures 178 extending through choke body 171 from counterbore 172 to annulus 157. Outlet apertures 178 permit fluid communication between counterbore 172, annulus 157, and piston actuation ports 151, 152. Each outlet aperture 178 has a longitudinal axis 178*a* oriented substantially parallel to axes 115, 175. In this embodiment, choke body 171 includes three outlet apertures 178 that are uniformly angularly spaced about 120° apart. In particular, one outlet aperture 178 is circumferentially positioned between each pair of adjacent arms 176. Apertures 178 are sized and configured to prevent plug 180 from passing or extruding therethrough, and thus, are sized and oriented to prevent plug 180 from inadvertently restricting fluid flow through ports 151, 152.

Referring again to FIGS. 6-8, during drilling operations, compressed fluid (e.g., compressed air, compressed nitrogen, etc.) is flowed down the drillstring, and through upper section 25*a* of passage 25 to check valve 57 in the direction of arrow 70. When the pressure differential across check valve 57 is sufficient, check valve 57 transitions to the opened position, thereby allowing fluid communication between the drillstring and fluid conduit passage 154 via annulus 25*d* and inlet ports 156. In passage 154, the compressed fluid continues its generally axially downward flow to choke 170 where the compressed fluid is divided into a first fraction or portion that flows between adjacent arms 176 into annulus 157 as represented by arrow 70*a*, and a second fraction or portion that flows into counterbore 172 of choke 170 as represented by arrow 70*b*. The first fraction of the compressed fluid through annulus 157 and piston actuation ports 151, 152 to passage 36, 37, respectively, and chambers 38, 39, respectively, thereby reciprocally actuating piston 35 as previously described. During the initial drilling phases, choke 170 is typically in the opened configuration shown in FIG. 7 (i.e., with no ball or plug 180 positioned in seat 174), and thus, the second fraction of the compressed fluid flows generally axially downward through counterbore 172 and bypass port 173 to piston passage 33, thereby bypassing chambers 38, 39. It should be appreciated that a portion of the compressed fluid flowing into counterbore 172 may flow radially through elongate apertures 178 to annulus 157.

During drilling (e.g., deep drilling), it may be desirable to increase the flow of compressed fluid to chambers 38, 39 in order to increase the frequency of impacts between piston 35 and hammer bit 60 and/or to increase the force of the impact between piston 35 and hammer bit 60. Embodiments of percussion drilling assembly 100 offer the potential to achieve increased impact frequency and/or impact forces between piston 35 and hammer bit 60 during downhole drilling operations by transitioning choke 170 from the opened position shown in FIG. 7 to the closed position shown in FIG. 8, even after the upper operating limits of the surface compressors are reach. In particular, plug 180 is placed in the flow of compressed fluid at the surface and is urged axially downward by the flow of compressed fluid and the force of gravity. With check valve 57 in the opened position, plug 180 travels through annulus 25*d*, through one of the fluid conduit inlet ports 156, and into fluid conduit passage 154. Once in passage 154, plug 180 continues its axially downward movement towards choke 170. Upon contact with the sloped upper guide surfaces 176*a* of arms 176, plug 180 is guided or funneled into counterbore 172. The continuous flow of compressed fluid 70 down passage 154 urges plug 180 into engagement with annular seat 174 thereby transitioning choke 170 from the opened position to the closed position. Once sufficiently seated, plug 180 restricts the flow of compressed fluid through bypass port 173. However, any compressed fluid flow into counterbore 172 is free to flow through elongate outlet apertures 178 into annulus 157 and piston actuation ports 151, 152, thereby increasing the total volumetric flow rate of compressed fluid through piston actuation ports 151, 152 to chambers 38, 39, respectively. Without being limited by this or any particular theory, the increased volumetric flow rate to chambers 38, 39 increases the frequency of impacts between piston 35 and hammer bit 60 and/or increases the force of the impact between piston 35 and hammer bit 60.

It should be appreciated that check valve 57, section 25*b*, annulus 25*d*, inlet ports 156, fluid conduit passage 154, and counterbore 172 are preferably sized to allow plug 180 to pass therethrough, while arms 176 and bypass port 173 are preferably sized to prevent plug 180 from passing into annulus 157 and piston passage 33, respectively.

Figure 10:
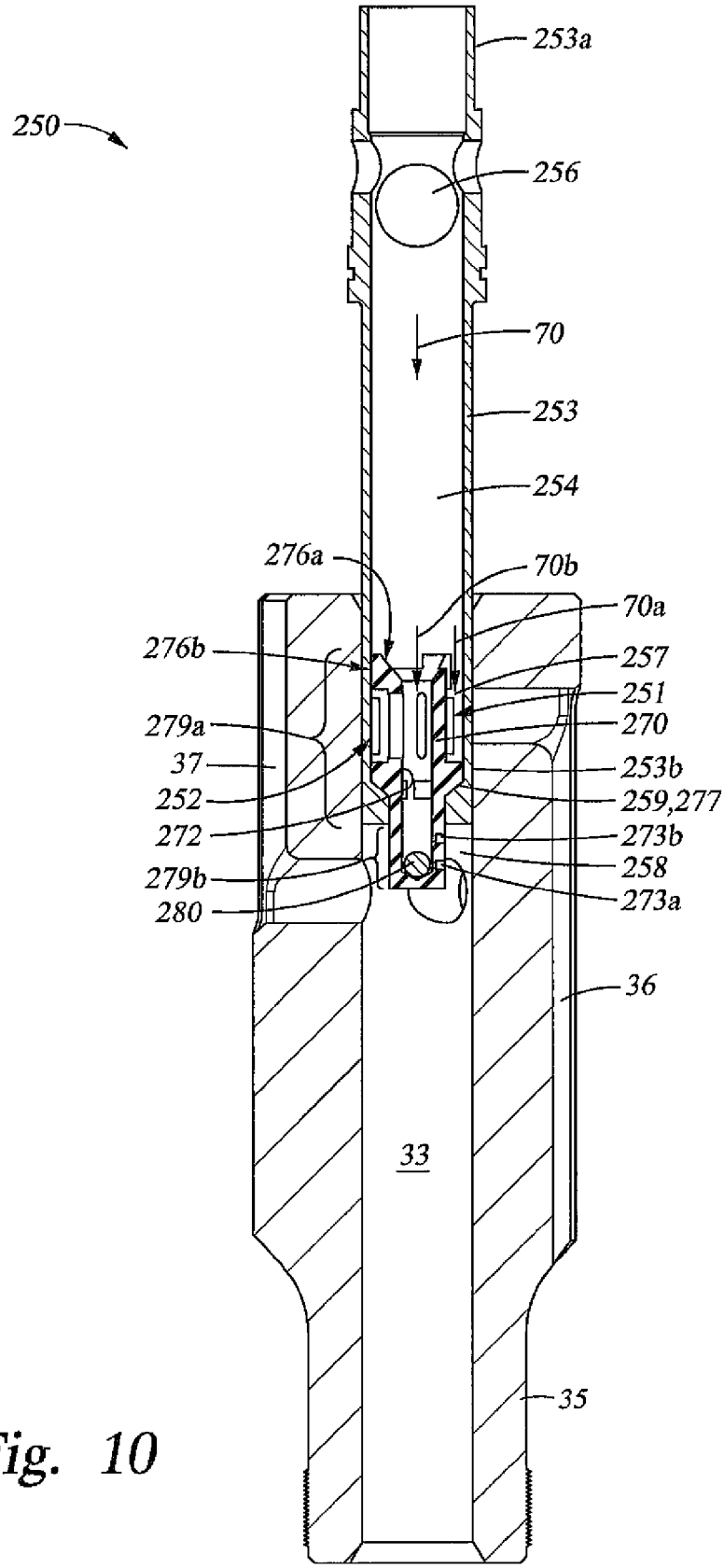
FIGS. 10 and 11 are cross-sectional views of select components of an embodiment of a percussion drilling assembly including an adjustable choke.
Figure 11:
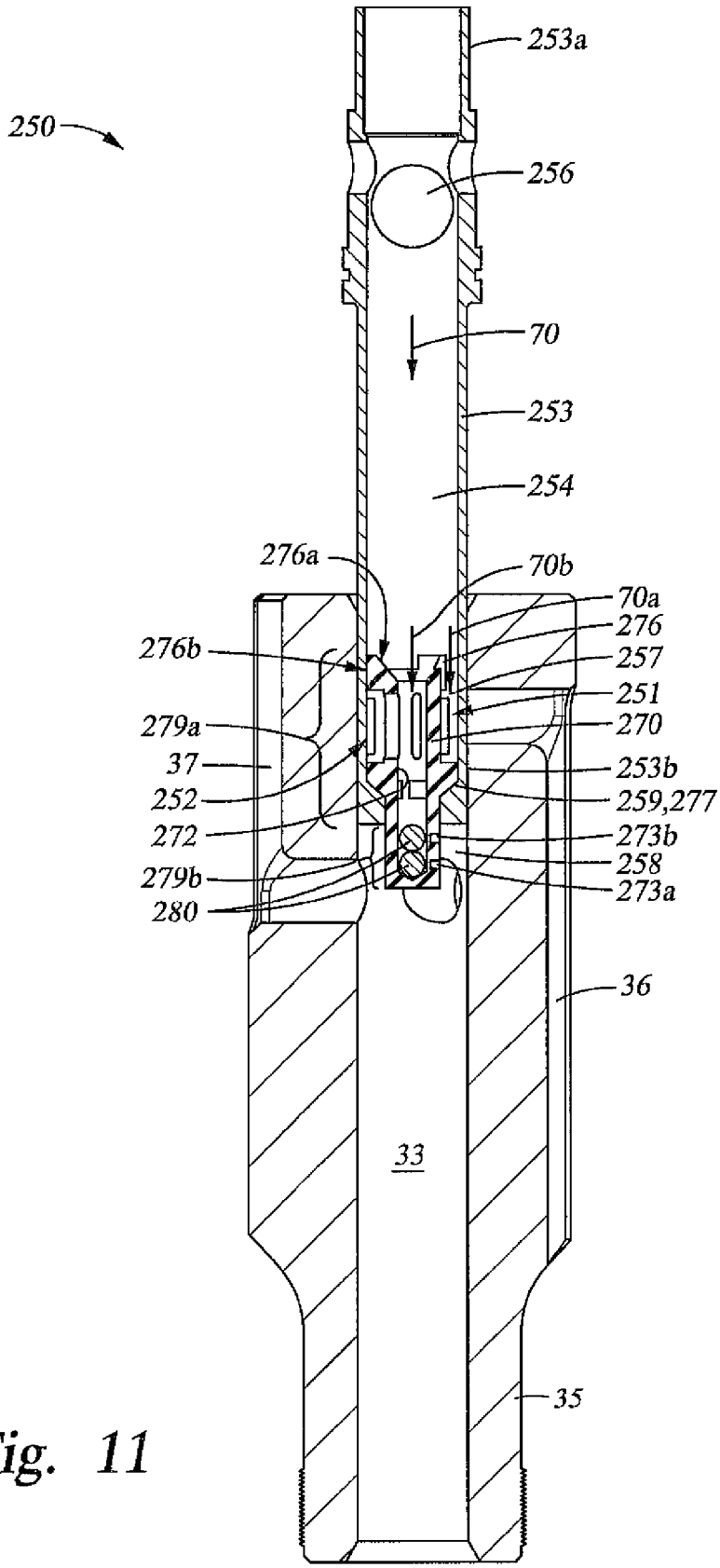

Referring now to FIGS. 10 and 11, another embodiment of a fluid conduit 250 and adjustable choke 270 are shown. Fluid conduit 250 and adjustable choke 270 may be used in percussion drilling assembly 10, 100 previously described. For purposes of clarity, the arrangement of fluid conduit 250, adjustable choke 270, and piston 35 previously described are shown, however, the remaining components of the percussion drilling assembly are not shown.

Fluid conduit 250 is similar to fluid conduit 150 previously described. Namely, fluid conduit 250 is coaxially aligned with the drilling assembly central axis and includes a tubular body 253 having an upper or inlet end 253*a*, a lower or outlet end 253*b*, and a central through passage 254 extending therebetween. Inlet end 253*a* includes a plurality of radial inlet ports or apertures 256 and is adapted to axially receive a check valve (e.g., check valve 57) that allows one-way fluid communication into passage 254 via inlet ports 256. Lower end 253*b* includes a first and a second radial outlet port 251, 252 and an annular shoulder 259 extending radially inward from body 253 downstream of ports 251, 252. As will be explained in more detail below, during drilling operations, first outlet port 251 and second outlet port 252 are alternatingly placed in fluid communication with flow passages 36, 37, respectively, and chambers 38, 39, respectively, thereby reciprocally actuating piston 35. Accordingly, outlet ports 251, 252 may also be referred to as "piston actuation" ports.

Figure 12A:
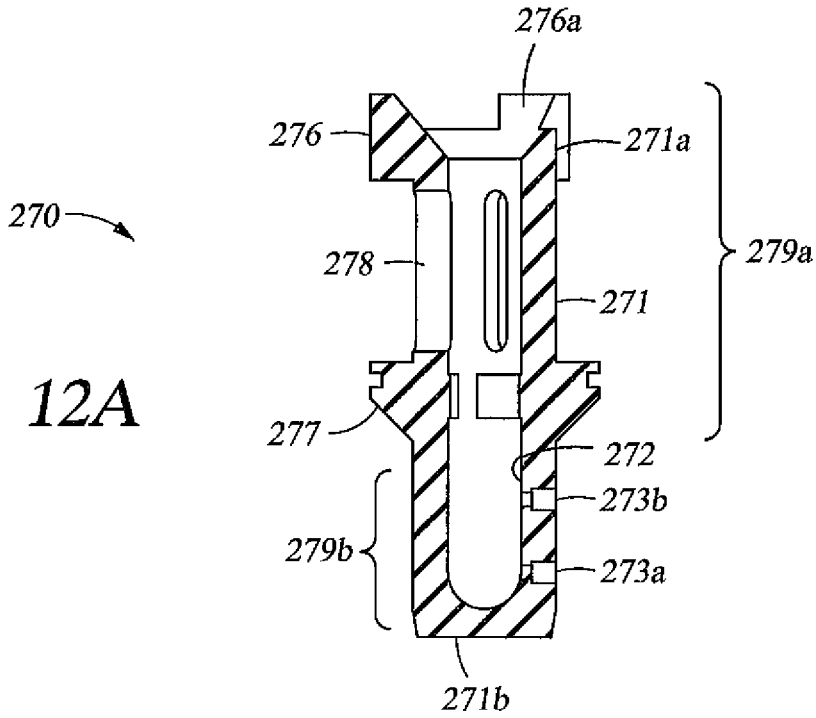
FIG. 12*a* is a cross-sectional view of the adjustable choke of FIGS. 10 and 11.
Figure 12B:
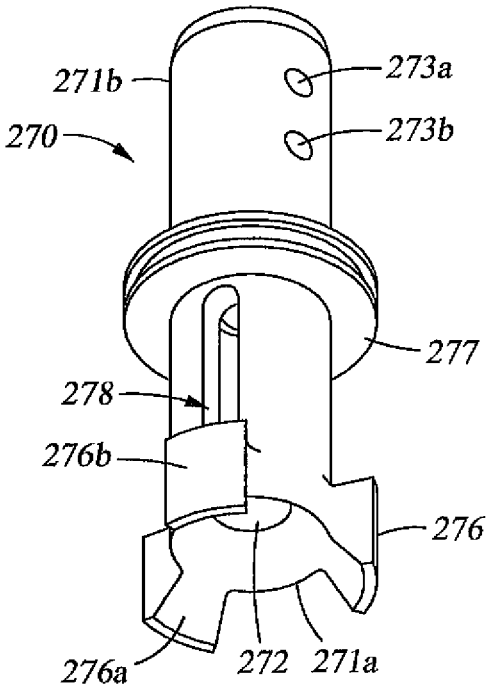
FIGS. 12*b* and 12*c* are perspective views of the adjustable choke of FIGS. 10 and 11.
Figure 12C:
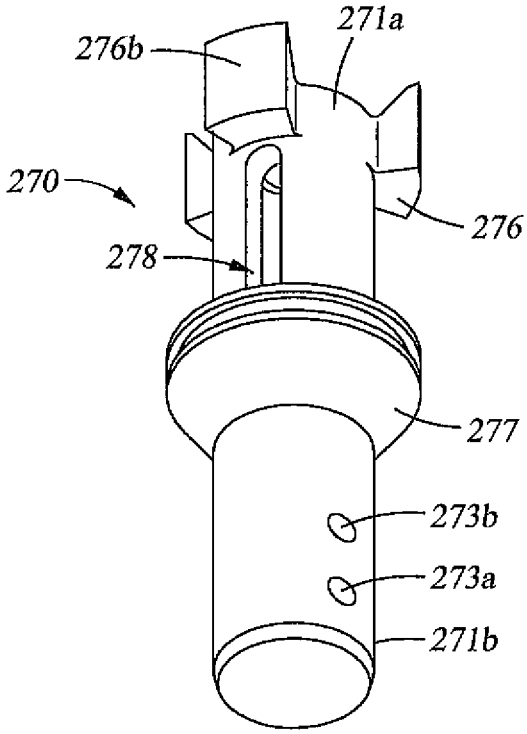

Referring now to FIGS. 10-12*c*, adjustable choke 270 is coaxially disposed in lower end 253*b* of fluid conduit body 253. As best shown in FIGS. 12*a*-12*c*, adjustable choke 270 comprises a generally cylindrical body 271, a plurality of arms 276 extending radially from body 271, and an annular flange 277 extending radially from the outer surface of body 271 and axially spaced from arms 276. Body 271 has an upper end 271*a* disposed in fluid conduit passage 254, a lower end 271*b* extending axially from lower end 253*b* of fluid conduit body 253. Thus, body 271 may also be described as having an upper or first portion 279*a* disposed in fluid conduit passage 254, and a lower or second portion 279*b* extending axially from lower end 235*b* of fluid conduit 250 (i.e., not disposed in fluid conduit passage 254). Lower portion 279*b* has an outer diameter that is less than the diameter of piston passage 33, and thus, an annulus 258 is formed between lower portion 279*b* and piston 35. In addition, choke body 271 includes a central counterbore 272 adapted to receive one or more plugs 280. Counterbore 272 extends axially downward from upper end 271*a*, but does not extend completely through choke body 271 to lower end 271*b*.

Arms 276 are integral with body 271 and extend radially from upper end 271*a* of body 271. In this embodiment, arms 276 are uniformly angularly spaced about 120° apart. Each arm 276 includes an upper guide surface 276*a* and a radially outer surface 276*b* that engages the inner surface of feed tube body 253. Upper guide surfaces 276*a* slope downward from fluid conduit body 253 towards the inlet of counterbore 272. Guide surfaces 276*a* are adapted to guide or funnel one or more plug(s) 280 into counterbore 272. Annular flange 277 is integral with body 271 and is axially disposed between ends 271*a*, 271*b*. As best shown in FIGS. 10 and 11, flange 277 engages mating shoulder 259 of fluid conduit 250.

Lower portion 279*b* includes a first or lower bypass port 273*a* positioned proximal lower end 271*b* and a second or upper bypass port 273*b* axially spaced above first bypass port 273*a* and generally distal lower end 271*b*. Each bypass port 273*a, b* extends radially through body 271 from counterbore 272 to annulus 258 and passage 33 of piston 35. Fluid flow from counterbore 272 to piston passage 33 through bypass ports 273*a, b* effectively bypasses passages 26, 37 and the piston-cylinder chambers (e.g., chambers 38, 39), and thus, does not contribute to the actuation of piston 35.

Referring still to FIGS. 10-12*c*, the outer diameter of choke body 271 is less than the diameter of passage 254, resulting in an annulus 257 axially positioned between arms 276 and flange 277, and generally aligned with piston actuation ports 251, 252 of fluid conduit 250. In addition, body 271 includes a plurality of elongate outlet ports or apertures 278 extending radially through body 271 from counterbore 272 to annulus 257.

As shown in FIG. 10, when a first ball or plug 280 is positioned at the bottom of counterbore 272, it restricts fluid flow from counterbore 272 to passage 33 through first bypass port 273*a*. Further, as shown in FIG. 11, when a second ball or plug 280 is positioned in counterbore 272, it restricts fluid flow from counterbore 272 to passage 33 through second bypass port 273*b*. In this manner, bypass ports 273*a, b* may be successively restricted with a first plug 280, and then a second plug 280. Accordingly, adjustable choke 270 may be described has having an "opened" position or configuration with no plugs 280 disposed in counterbore 272 (i.e., fluid flow through bypass ports 273*a, b* is not restricted); a "partially restricted" configuration with one plug 280 disposed in counterbore 272 (i.e., fluid flow through first bypass port 273*a* is restricted, but fluid flow through second bypass port 273*b* is not restricted); and a "closed" configuration with two plugs 280 disposed in counterbore 272 (i.e., fluid flow through first and second bypass ports 273*a, b* is restricted). Although two bypass ports 273*a, b* are included in this embodiment, in other embodiments, three or more outlet ports may be employed as desired.

In this embodiment, counterbore 272 has a substantially uniform diameter. However, in other embodiments, the counterbore (e.g., counterbore 272) may have a reduced diameter inlet portion or throat that allows one or more plugs (e.g., plug 280) to enter the counterbore, but restricts the plug from flowing back. In such embodiments, the plug inherently operates similar to a one-way check valve. For example, the plug may prevent backflow of air and cuttings into the feed tube when the compressed fluid flow is shut off and pressure within the borehole seeks to drive air and cutting into the percussion drilling assembly.

Referring again to FIGS. 10 and 11, during drilling operations, compressed fluid is flowed down drillstring (e.g., drillstring 11) to the check valve (not shown) disposed at upper end 253*a* of fluid conduit body 250. When the pressure of the compressed fluid is sufficient, the check valve transitions to the opened position, thereby allowing fluid communication between the drillstring and passage 254 via inlet ports 256. Within passage 254, the compressed fluid continues its generally axially downward flow represented by arrow 70 to adjustable choke 270 where the compressed fluid is divided into a first fraction represented by arrow 70*a* that flows through the circumferential spaces between arms 276, into annulus 257 and radially outward through piston actuation ports 251, 252, and a second fraction represented by arrow 70*b* that flows into counterbore 272 of adjustable choke 270. The first fraction flows to the piston-cylinder chambers (e.g., chambers 38, 39) and functions to actuate the piston (e.g., piston 35) as previously described. During initial drilling, adjustable choke 270 is typically in the opened configuration with no ball or plug (e.g., plug 280) in counterbore 272, and thus, the second fraction of compressed fluid flowing into counterbore 272 is free to flow through bypass ports 273*a, b* and into passage 33, thereby effectively bypassing the piston-cylinder chambers.

Referring specifically to FIG. 10, to increase the frequency of impacts between the piston (e.g., piston 35) and the hammer bit (e.g., hammer bit 60) and/or to increase the force of the impacts between the piston and the hammer bit, a first plug 280 is placed in the flow of compressed fluid at the surface. Plug 280 travels down the drillstring (e.g., drillstring 11) with the compressed fluid. With the check valve in the opened position, plug 280 moves through inlet ports 256 and into passage 254 of fluid conduit 250. Once in passage 254, plug 280 will be carried by the compressed fluid axially downward to adjustable choke 270. Plug 280 engages guide surfaces 276*a* and is funneled into counterbore 272. Gravity as well as the continuous flow of compressed fluid down passage 254 urges plug 280 towards the bottom of counterbore 272. Once seated at the bottom of counterbore 272, plug 280 restricts the flow of compressed fluid through first bypass port 273*a*, thereby transitioning adjustable choke 270 to the partially restricted configuration. As compared to the opened configuration, the partially restricted configuration results in a decreased volumetric flow rate through bypass ports 273*a, b* and an increased volumetric flow rate through outlet ports 252 to the piston-cylinder chambers, thereby increasing the frequency of impacts between the piston and the hammer bit and/or to increase the force of the impact between the piston and the hammer bit Referring now to FIG. 11, for further increases in the frequency of impacts between the piston and the hammer bit and/or the force of the impact between the piston and the hammer bit, a second plug 280 may be placed in the flow of compressed fluid at the surface. The second plug 280 will take substantially the same path into counter bore 272 as the first plug 280 previously described. Once disposed in the lower portion of counterbore 272 immediately adjacent first plug 280, the second plug 280 restricts the flow of compressed fluid through second bypass port 273*b*, thereby transitioning adjustable choke 270 to the closed configuration. As compared to the opened and the partially restricted configurations, the closed configuration results in a further decrease in volumetric flow rate through bypass ports 273*a, b* and a further increased volumetric flow rate through outlet ports 252 to the piston-cylinder chambers. In this manner, the volumetric flow rate of compressed fluid to the piston-cylinder chambers may be progressively increased with a first plug 280 and a second plug 280. Although two ports 273*a, b* are included in this embodiment, in other embodiments, more than two axially spaced ports may be utilized. In such embodiments, the flow of compressed fluid through each port may be successively restricted by a first plug, second plug, third plug, etc. as desired to increase the volumetric flow rate of compressed fluid to the piston-cylinder chambers.

Figure 13:
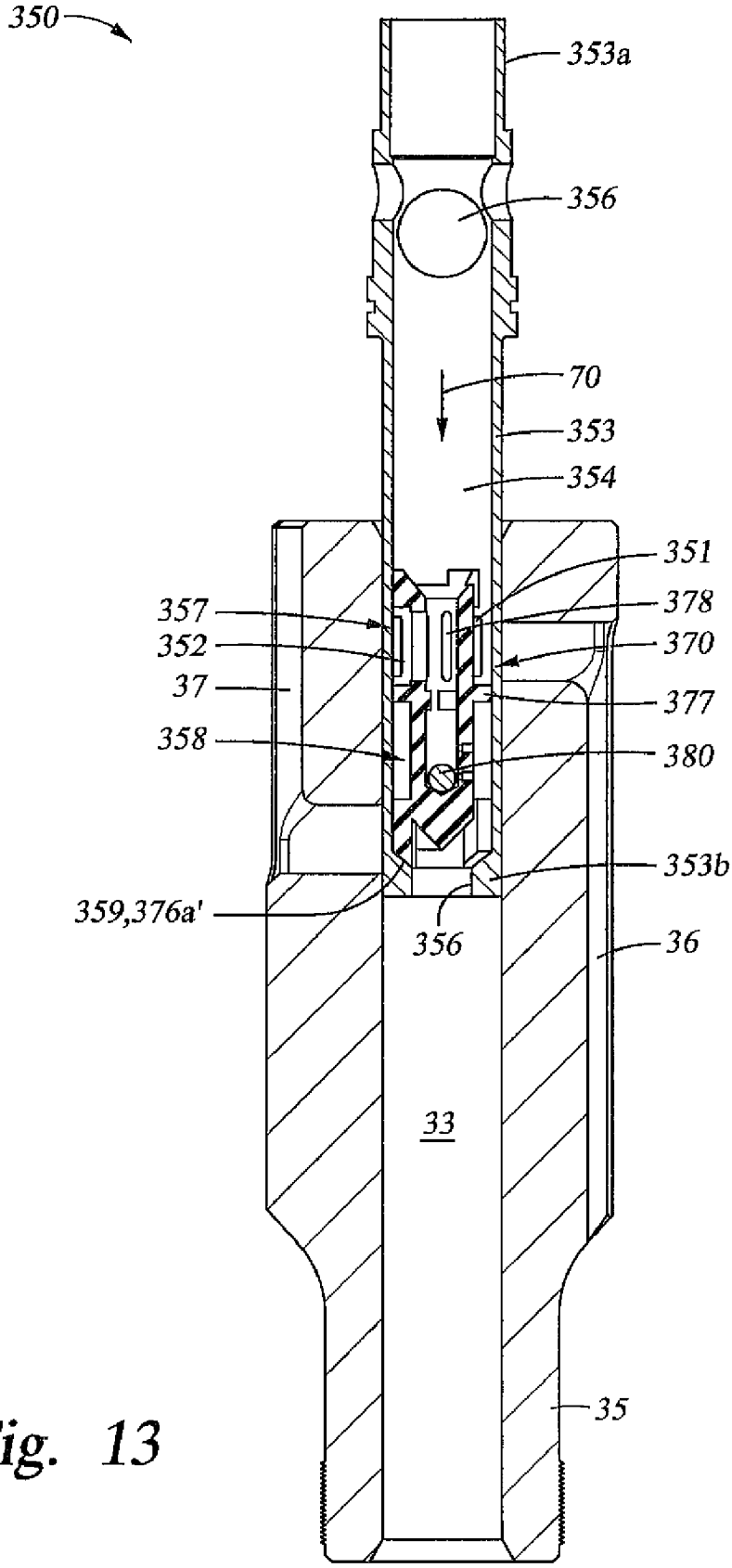
FIG. 13 is a cross-sectional view of select components of an embodiment of a percussion drilling assembly including an adjustable choke.

Referring now to FIG. 13, another embodiment of a fluid conduit 350 and adjustable choke 370 are shown. Fluid conduit 350 and adjustable choke 370 may be used in percussion drilling assembly 10, 100 previously described. For purposes of clarity, the arrangement of fluid conduit 350, adjustable choke 370, and piston 35 previously described are shown, however, the remaining components of the percussion drilling assembly are not shown.

Fluid conduit 350 is similar to fluid conduit 150, 250 previously described. Namely, fluid conduit 350 is coaxially aligned with the drilling assembly central axis and includes a tubular body 353 having an upper or inlet end 353*a*, a lower or outlet end 353*b*, and a central through passage 354 extending therebetween. Inlet end 353*a* includes a plurality of radial inlet ports or apertures 356 and is adapted to axially receive a check valve (e.g., check valve 57) that allows one-way fluid communication into passage 354 via inlet ports 356. Lower end 353*b* includes an outlet 356 in fluid communication with passage 33.

Proximal lower end 353*b*, fluid conduit 350 includes a first and a second radial outlet port 351, 352 and an annular shoulder 359 extending radially inward from body 253 downstream of ports 351, 352. As will be explained in more detail below, during drilling operations, first outlet port 351 and second outlet port 352 are alternatingly placed in fluid communication with flow passages 36, 37, respectively, and chambers 38, 39, respectively, thereby reciprocally actuating piston 35. Accordingly, outlet ports 351, 352 may also be referred to as "piston actuation" ports. Adjustable choke 370 is coaxially disposed within passage 354 in lower end 353*b* of fluid conduit body 353.

Figure 14A:
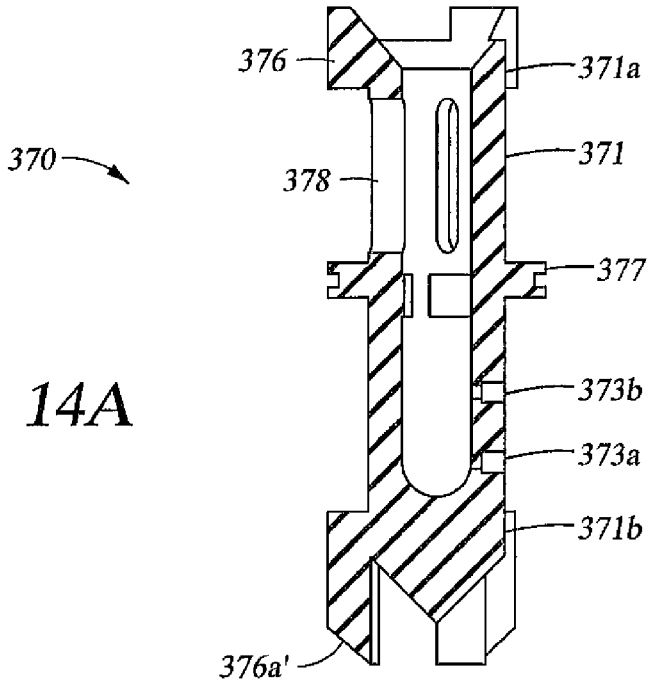
FIG. 14*a* is a cross-sectional view of the adjustable choke of FIG. 13.
Figure 14B:
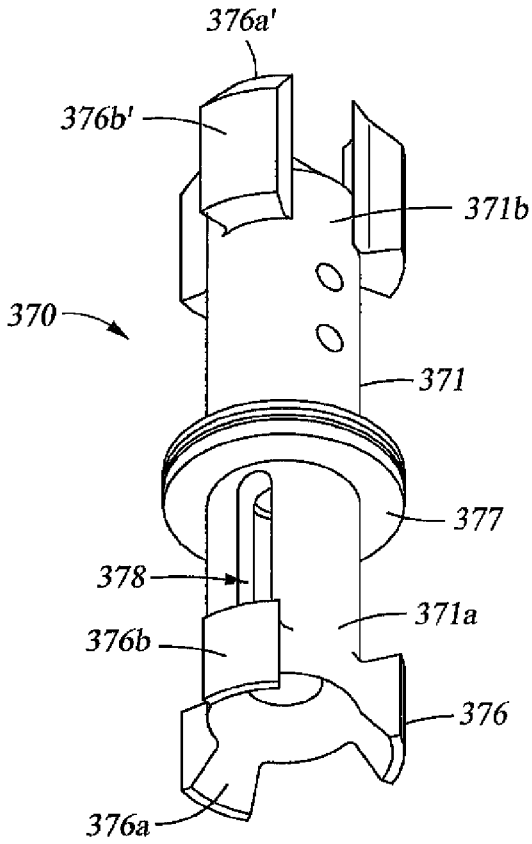
FIGS. 14*b* and 14*c* are perspective views of the adjustable choke of FIG. 13.
Figure 14C:
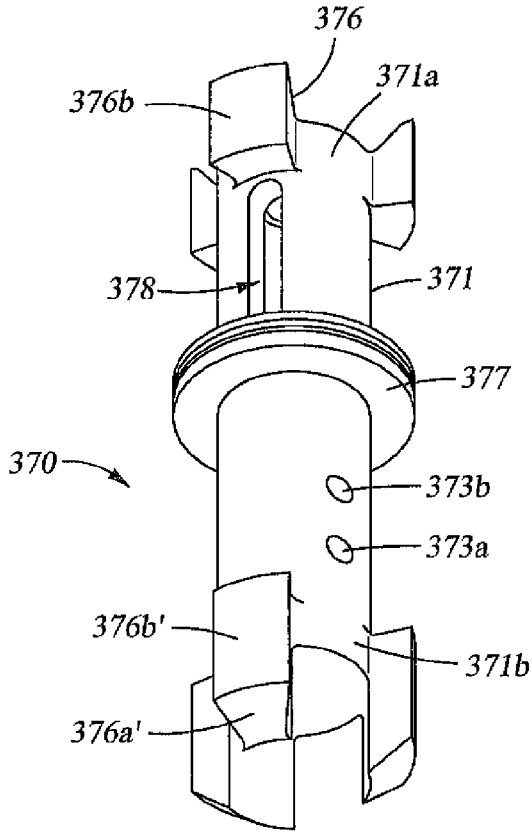

As best shown in FIGS. 14*a*-14*c*, adjustable choke 370 is similar to adjustable choke 270 previously described. Namely, adjustable choke 370 comprises a generally cylindrical body 371 having an upper end 371*a* and a lower end 371*b*. In addition, choke 370 includes a plurality of arms 376 extending radially from upper end 371*a* of body 371 and an annular flange 377 extending radially from the outer surface of body 371 and axially spaced from arms 376. In addition, choke body 371 includes a central counterbore 372 adapted to receive one or more plugs 380. Counterbore 372 extends axially downward from upper end 371*a*, but does not extend completely through choke body 371 to lower end 371*b*. In this embodiment, counterbore 372 has a substantially uniform diameter. However, unlike choke 270 previously described, in this embodiment, choke 370 also includes a second plurality of arms 376' extending from lower end 371*b* of body 371 and axially spaced from flange 377. Further, in this embodiment, adjustable choke 370 is completely disposed within passage 354. In other words, no portion of adjustable choke 370 extends from lower end 353*b* of fluid conduit 350.

Arms 376, 376' are integral with body 371 and extend radially from ends 371*a*, 371*b*, respectively. In this embodiment, arms 376 are uniformly angularly spaced about 120° apart. Each arm 376 includes an upper guide surface 376*a* and a radially outer surface 376*b* that engages the inner surface of feed tube body 353. Upper guide surfaces 376*a* slope downward from fluid conduit body 353 towards the inlet of counterbore 372. Guide surfaces 376*a* are adapted to guide or funnel one or more plug(s) 380 into counterbore 372. Annular flange 377 is integral with body 371 and is axially disposed between ends 371*a*, 371*b*. As best shown in FIG. 13, flange 377 extends radially to body 353. Arms 376' are also uniformly angularly spaced about 120° apart. Each arm 376' includes a lower surface 376*a*' that engages mating shoulder 359 of fluid conduit 350, and a radially outer surface 376*b*' that engages the inner surface of feed tube body 353.

Referring again to FIG. 13, the outer diameter of choke body 371 is less than the diameter of passage 354, resulting in a first annulus 357 axially positioned between arms 376 and flange 377 that is generally aligned with piston actuation ports 351, 352 of fluid conduit 350, and a second annulus 358 axially positioned between flange 377 and arms 376'. First annulus 357 is in fluid communication with ports 351, 352, and second annulus 358 is in fluid communication with passage 33 via the voids or spaces formed circumferentially between arms 376' and outlet 356. It should be appreciated that annulus 357 is not in fluid communication with annulus 358. In some embodiments, a seal such as an O-ring seal may be included to restrict and/or prevent fluid communication between annulus 357 and annulus 358. In particular, flange 377 restricts and/or prevents fluid communication between annuli 357, 358.

As best shown in FIGS. 14*a*-14*c*, body 371 also includes a plurality of elongate outlet ports or apertures 378 extending radially through body 371 from counterbore 372 to annulus 357, and bypass ports 373*a*, 373*b* extending radially from counterbore 372 to annulus 358. In particular, first or lower bypass port 373*a* positioned axially between arms 376, 376', and a second or upper bypass port 373*b* positioned axially between arms 376, 376', and axially spaced above first bypass port 373*a*. Fluid flow from counterbore 372 to piston passage 33 through bypass ports 373*a, b* effectively bypasses passages 26, 37 and the piston-cylinder chambers (e.g., chambers 38, 39), and thus, does not contribute to the actuation of piston 35.

As shown in FIG. 13, when a first ball or plug 380 is positioned at the bottom of counterbore 372, it restricts and/or prevents fluid flow from counterbore 372 to passage 33 through first bypass port 373*a*. Further, when a second ball or plug 380 is positioned in counterbore 372, it restricts and/or prevents fluid flow from counterbore 372 to passage 33 through second bypass port 373*b*. In this manner, bypass ports 373*a, b* may be successively restricted with a first plug 380, and then a second plug 380. Accordingly, adjustable choke 370 may be described has having an "opened" position or configuration with no plugs 380 disposed in counterbore 372 (i.e., fluid flow through bypass ports 373*a, b* is not restricted); a "partially restricted" configuration with one plug 380 disposed in counterbore 372 (i.e., fluid flow through first bypass port 373*a* is restricted, but fluid flow through second bypass port 373*b* is not restricted); and a "closed" configuration with two plugs 380 disposed in counterbore 372 (i.e., fluid flow through first and second bypass ports 373*a, b* is restricted). Although two bypass ports 373*a, b* are included in this embodiment, in other embodiments, three or more outlet ports may be employed as desired.

Adjustable choke 370 operates substantially the same as adjustable choke 270 previously described with the key different being that any compressed fluid flowing through bypass ports 373*a, b* flows through annulus 358 and the spaces or voids between arms 376' before entering passage 33 through outlet 356.

Although lower arms 376' are included in the embodiment of adjustable choke 370 shown in FIGS. 13 and 14*a*-14*c*, in other embodiment disposed entirely in the fluid conduit, the lower arms (e.g., arms 376') may be eliminated and the adjustable choke may be axially supported by a shoulder axially spaced from the lower end of the feed tube body that extends radially inward and engages a mating flange (e.g., flange 377) extending radially from the adjustable choke body (e.g., body 371).

Figure 15:
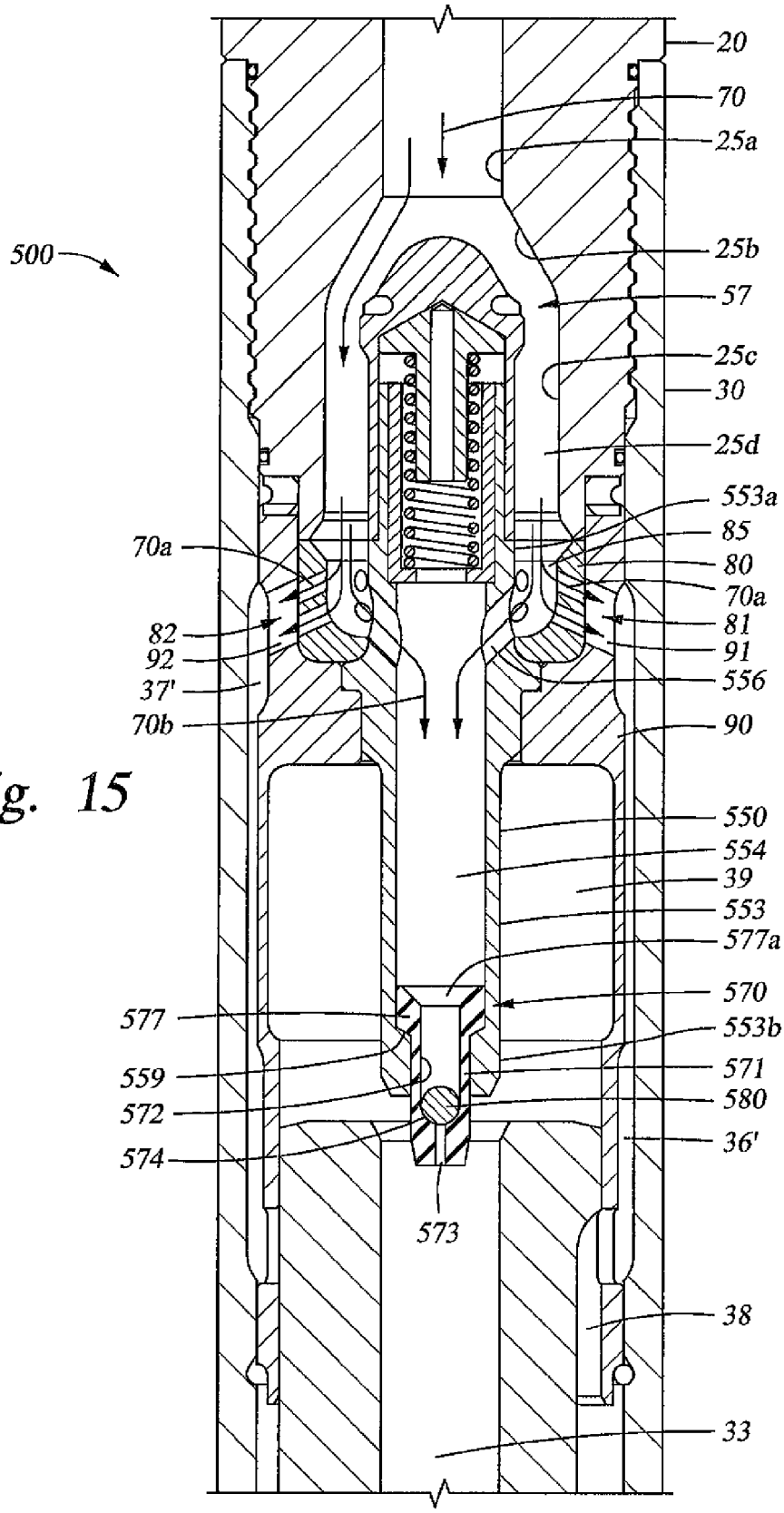
FIG. 15 is a cross-sectional view of select components of an embodiment of a percussion drilling assembly including an adjustable choke.

Referring now to FIG. 15, an embodiment of a percussion drilling assembly 500 including an adjustable choke 570 is shown. Percussion drilling assembly 500 is similar to percussion drilling assembly 100 previously described, except that assembly 500 employs an air distributor assembly design as opposed to a feed tube design. More specifically, assembly 500 is connected to the lower end of a drillstring (not shown) and includes a top sub 20, a driver sub (not shown), a tubular case 30, a piston 35, and a hammer bit (not shown). A fluid conduit 550 extends between top sub 20 and piston 35. In this embodiment, assembly 500 includes a flow diverter 80 disposed about fluid conduit 550 axially adjacent top sub 20, and a distributor sleeve 90 disposed about fluid conduit 550 and extends from flow diverter 80 to piston 35. An annulus 85 in fluid communication with annulus 25*d* is formed between flow diverter 80 and fluid conduit 550.

Flow diverter includes a first plurality of radial outlet ports or apertures 81 aligned with ports 91 extending radially through the upper portion of distributor sleeve 90, and a second plurality of radial outlet ports or apertures 82 aligned with ports 92 extending radially through the upper portion of distributor sleeve 90. Ports 81, 91 are in fluid communication with flow passages 36' formed radially between distributor sleeve 90 and case 30, and ports 82, 92 are in fluid communication with flow passages 37' formed radially between distributor sleeve 90 and case 30. Flow passages 36', 37' are alternatingly placed in fluid communication with piston-cylinder chambers (e.g., piston-cylinder chambers 38, 39) as piston 35 actuates. In particular, when piston 35 is in its lower most position, passage 36' is in fluid communication with lower piston-cylinder chamber 38, and thus, compressed fluid flows down the drillstring, through annulus 25*d*, annulus 85, ports 81, and passage 36' to chamber 38, thereby pressurizing chamber 38 and driving piston 35 axially upward. Further, when piston 35 is in its uppermost position, passage 37' is in fluid communication with upper piston-cylinder chamber 39, and thus, compressed fluid flows down the drillstring, through annulus 25*d*, annulus 85, ports 82, and passage 37' to chamber 39, thereby pressurizing chamber 38 and driving piston 35 axially upward. Accordingly, outlet ports 81, 82 may also be referred to as "piston actuation" ports. It should be appreciated piston 35 closes off passage 37' when it is in its uppermost position, and blocks passage 36' when it is in its lowermost position. When piston 35 is actuated upwards, fluid in upper chamber 39 is exhausted directly to passage 33 in piston 35, and when piston 35 is actuated downwards, fluid in lower chamber 38 is exhausted directly to the hammer bit (e.g., central passage 65 in hammer bit 60).

Referring still to FIG. 15, fluid conduit 550 includes a tubular body 553 having an upper or inlet end 553*a*, a lower or outlet end 553*b*, and a central through passage 554 extending therebetween, and an adjustable choke 570 coaxially disposed within lower end 553*b* of body 553. Inlet end 553*a* includes a plurality of inlet ports or apertures 556 providing fluid communication between annulus 85 and passage 554. A check valve 57 as previously described is partially received by inlet end 553*a*, and allows one-way fluid communication from upper section 25*a* to annuli 25*d*, 85.

Figure 16A:
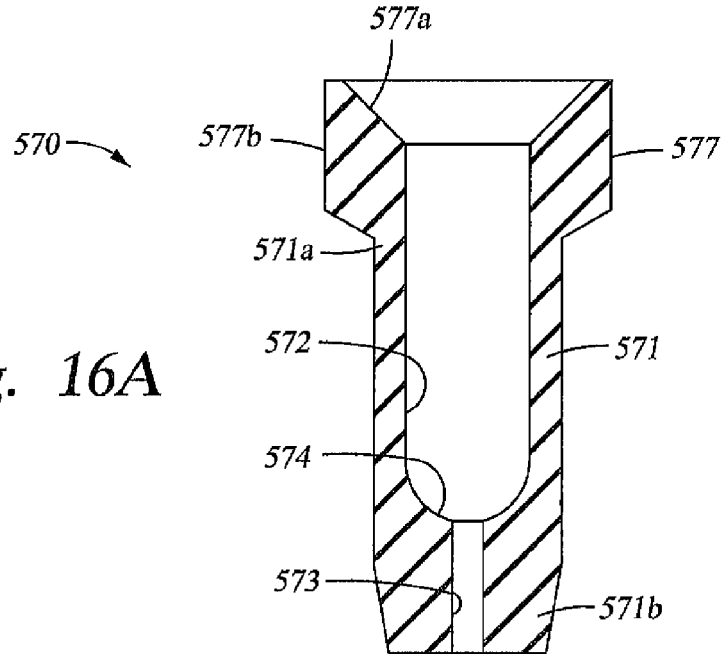
FIG. 16*a* is a cross-sectional view of the adjustable choke of FIG. 15.
Figure 16B:
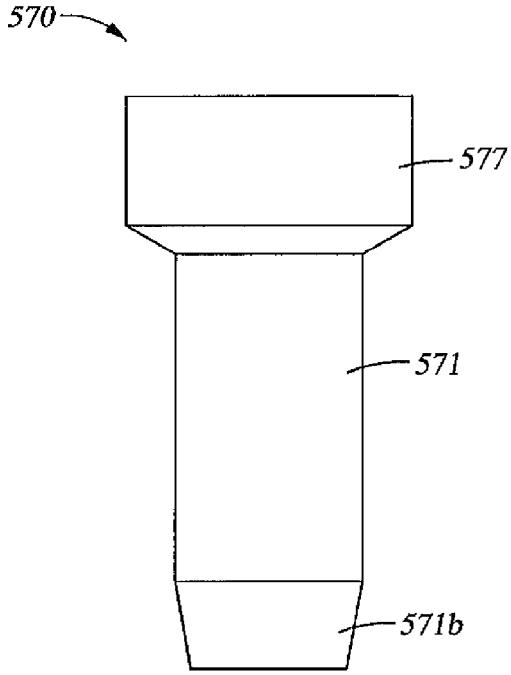
FIG. 16*b* is a side view of the adjustable choke of FIG. 15.
Figure 16C:
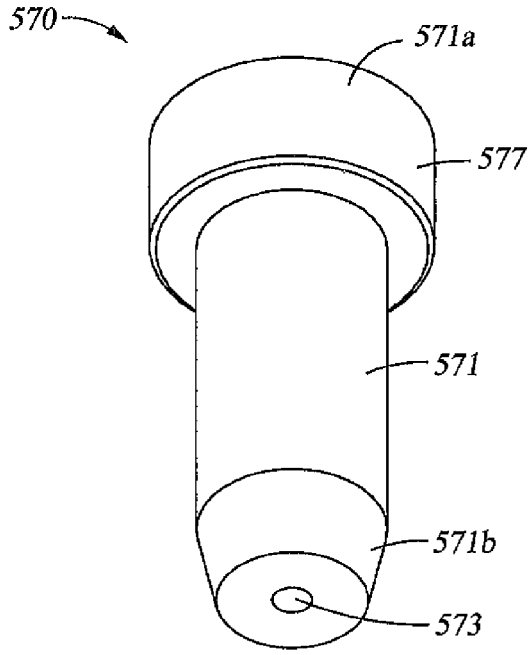
FIG. 16*c* is perspective views of the adjustable choke of FIG. 15.

As best shown in FIGS. 16*a*-16*c*, adjustable choke 570 comprises a generally cylindrical body 571 and a flange 577. In particular, body 571 has an upper end 571*a*, a lower end 571*b*, a counterbore 572 extending axially from upper end 571*a*, and a bore or port 573 extending axially from counterbore 572 to lower end 571*b*. Compressed fluid flow through port 573 effectively bypasses passages 36', 37' and chambers 38, 39, and therefore does not contribute to the actuation of piston 35. Consequently, port 573 may also be referred to as a bypass port.

Bypass port 573 has a diameter that is less than the diameter of counterbore 572. An annular spherical seat 574 configured to receive a plug or ball 580 (FIG. 15) is formed at the intersection of counterbore 572 and bypass port 573. As best shown in FIG. 15, when plug 580 is sufficiently seated in seat 574, it restricts and/or shuts off the flow of fluids from passage 554 to piston passage 33 through reduced diameter bypass port 573. Accordingly, choke 570 may be described as having an "opened" position or configuration permitting the flow of compressed fluid through bypass port 573 to piston passage 33 (i.e., no plug disposed in seat 574), and a "closed" position or configuration in which the flow of compressed fluid through bypass port 573 is restricted and/or shut off (i.e., plug 580 seated in seat 574). When adjustable choke 570 is sufficiently disposed within fluid conduit 550, annular shoulder 577 engages a mating shoulder 559 extending radially inward from body 553 of fluid conduit 150.

Referring now to FIGS. 15 and 16*a*-16*c*, flange 577 includes an upper generally inverted frustoconical guide surface 577*a* and a radially outer surface 577*b*. Outer surface 577*b* engages the inner surface of feed tube body 553. Upper guide surface 577*b* slopes downward from the inner surface of fluid conduit 550 towards bore 572, thereby functioning to guide or funnel plug 580 into counterbore 572.

Referring now to FIG. 15, during drilling operations, compressed fluid (e.g., compressed air, compressed nitrogen, etc.) is flowed down the drillstring, and through upper section 25*a* of passage 25 to check valve 57 in the direction of arrow 70. When the pressure differential across check valve 57 is sufficient, check valve 57 transitions to the opened position, thereby allowing fluid communication between the drillstring and annulus 25*d* and annulus 85. The compressed fluid is divided into a first fraction represented by arrow 70*a* that flows from annulus 85 through ports 81, 82, and a second fraction represented by arrow 70*b* that flows through ports 556 into passage 554. The first fraction flows through ports 81, 82 to passages 36', 37', respectively, and chambers 38, 39, respectively, thereby reciprocally actuating piston 35 as previously described. The second fraction continues its axially downward flow to choke 570. During the initial drilling phases, choke 570 is typically in the opened configuration (i.e., with no ball or plug 580 positioned in seat 574), and thus, the second fraction of the compressed fluid flows generally axially downward through counterbore 572 and bypass port 573 to piston passage 33, thereby bypassing chambers 38, 39.

To increase the impact frequency and/or impact forces between piston 35 and the hammer bit (e.g., hammer bit 60) during downhole drilling operations, adjustable choke 570 is transitioned from the opened position to the closed position shown in FIG. 15. In particular, plug 580 is placed in the flow of compressed fluid at the surface and is urged axially downward by the flow of compressed fluid and the force of gravity. With check valve 57 in the opened position, plug 580 travels through annulus 25*d*, through annulus 85, and through one of the fluid conduit inlet ports 556 into fluid conduit passage 554. It should be appreciated that ports 81, 82 in flow diverter 80 are sized such that plug 580 cannot pass therethrough into passages 36', 37'. Once in passage 554, plug 580 continues its axially downward movement towards choke 570. Upon contact with the sloped upper guide surface 577*a*, plug 580 is guided or funneled into counterbore 572. The continuous flow of compressed fluid 70 down passage 554 urges plug 580 into engagement with annular seat 574 thereby transitioning choke 570 from the opened position to the closed position. Once sufficiently seated, plug 580 restricts and/or prevents the flow of compressed fluid through bypass port 573. With adjustable choke 570 in the closed position, the volumetric flow rate of the second fraction of compressed fluid decreases, and the volumetric flow rate of the first fraction of compressed fluid increases, thereby increasing the frequency of impacts between piston 35 and the hammer bit and/or increases the force of the impact between piston 35 and hammer bit.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A percussion drilling assembly for drilling through earthen formations and forming a borehole, the assembly coupled to the lower end of a drillstring and comprising:

a fluid conduit including a tubular body having a first end, a second end, a through passage extending between the first end and the second end, an inlet port in fluid communication with the through passage, and at least one outlet port in fluid communication with the through passage of the fluid conduit; and an adjustable choke at least partially disposed in the through passage and adapted to decrease the volumetric flow rate of a compressed fluid through the first bypass port;

a first annulus positioned radially between the adjustable choke and the at least one outlet port of the fluid conduit, wherein the first annulus is in fluid communication with the through passage of the flow conduit and the at least one outlet port of the flow conduit;

wherein the adjustable choke comprises:

a body having an upper end, a lower end, a counterbore extending axially from the upper end, and a first bypass port extending from the counterbore;

wherein the upper end comprises a sloped guide surface adapted to guide a plug into the counterbore;

at least one aperture extending radially through the body from the counterbore to the first annulus, wherein the at least one aperture is axially positioned between the upper end and the first bypass port.

2. The assembly of claim 1 further comprising:

a top sub having a through passage in fluid communication with the drill string;

a check valve coupled to the fluid conduit, wherein the check valve allows one-way fluid communication from the through passage of the top sub to the through passage of the fluid conduit;

a tubular casing having an upper end coupled to the top sub and a lower end coupled to a drill bit;

a piston slidingly disposed in the casing, wherein the piston includes an upper end, a lower end, and through passage extending therebetween;

wherein the fluid conduit has a central axis and extends from the through passage of the top sub to the through passage of the piston;

wherein the adjustable choke controllably decreases volumetric fluid flow between the through passage of the fluid conduit and the through passage of the piston; and wherein the drill bit includes a longitudinal bore in fluid communication with the through passage of the piston and a nozzle in a formation engaging face of the bit.

3. The assembly of claim 2 wherein the adjustable choke has a first configuration allowing a first volumetric flow rate through the first bypass port and a second configuration allowing a second volumetric flow rate through the first bypass port that is less than the first volumetric flow rate.

4. The assembly of claim 3 wherein the first bypass port is in fluid communication with the through passage of the fluid conduit with the adjustable choke in the first configuration, and the through passage of the fluid conduit is not in fluid communication with the first bypass port with the adjustable choke in the second configuration.

5. The assembly of claim 2 wherein the adjustable choke is adapted to increase the volumetric flow rate of the compressed fluid through the at least one outlet.

6. The assembly of claim 5 wherein the adjustable choke has a first configuration allowing a first volumetric flow rate through the at least one outlet port and a second configuration allowing a second volumetric flow rate through the at least one outlet port that is greater than the first volumetric flow rate.

7. The assembly of claim 5 further comprising:

a first chamber and a second chamber in the casing;

wherein the at least one outlet port in the fluid conduit comprises a first outlet port and a second outlet port, each outlet port in fluid communication with the through passage of the fluid conduit; and wherein the piston has a first position with the first outlet port in fluid communication with the first chamber and a second position with the second outlet port in fluid communication with the second chamber.

8. The assembly of claim 7 wherein the first bypass port extends axially from the counterbore to the lower end;

wherein the counterbore is in fluid communication with the through passage of the fluid conduit and the first bypass port is in fluid communication with the through passage of the piston; and wherein the first bypass port and the counterbore intersect at a seat adapted to receive the plug that restricts fluid flow through the first bypass port.

9. The assembly of claim 8 wherein the adjustable choke has an opened configuration with the through passage of the fluid conduit in fluid communication with the through passage of the piston through the first bypass port, and a closed configuration with fluid flow through the first bypass port restricted by the plug seated in the seat.

10. The assembly of claim 7 wherein the adjustable choke comprises:

a first portion of the body is disposed in the through passage of the fluid conduit and a second portion of the body extends from the fluid conduit;

wherein the first bypass port is disposed in the lower portion, and extends radially from the counterbore to the piston through passage; and a second bypass port in the lower portion axially spaced from the first bypass port, the second bypass port extending radially from the counterbore to the through passage of the piston.

11. The assembly of claim 10 wherein the counterbore is adapted to receive a first plug and a second plug, wherein the first plug restricts fluid flow through the first bypass port and the second plug restricts fluid flow through the second bypass port.

12. The assembly of claim 11 wherein the adjustable choke has an opened configuration with the through passage of the fluid conduit in fluid communication with the through passage of the piston through the first bypass port and through the second bypass port, a partially restricted configuration with a first plug in the counterbore restricting fluid flow through the first bypass port, and the through passage of the fluid conduit in fluid communication with the through passage of the piston through the second bypass port, and a closed configuration with the first plug restricting fluid flow through the first bypass port choke and a second plug in the counterbore restricting fluid flow through the second bypass port.

13. A percussion drilling assembly for drilling through earthen formations and forming a borehole, the assembly coupled to the lower end of a drillstring and comprising:

a fluid conduit including a tubular body having a first end, a second end, a through passage extending between the first end and the second end, and an inlet port in fluid communication with the through passage; and an adjustable choke at least partially disposed in the through passage and including a first bypass port, wherein the adjustable choke is adapted to decrease the volumetric flow rate of a compressed fluid through the first bypass port;

a top sub having a through passage in fluid communication with the drill string;

a check valve coupled to the fluid conduit, wherein the check valve allows one-way fluid communication from the through passage of the top sub to the through passage of the fluid conduit;

a tubular casing having an upper end coupled to the top sub and a lower end coupled to a drill bit;

a piston slidingly disposed in the casing, wherein the piston includes an upper end, a lower end, and through passage extending therebetween;

wherein the fluid conduit has a central axis and extends from the through passage of the top sub to the through passage of the piston;

wherein the adjustable choke controllably decreases volumetric fluid flow between the through passage of the fluid conduit and the through passage of the piston; and wherein the drill bit includes a longitudinal bore in fluid communication with the through passage of the piston and a nozzle in a formation engaging face of the bit;

a flow diverter disposed about the fluid conduit axially adjacent the top sub;

a distributor sleeve disposed about the fluid conduit and extending axially from the flow diverter to the piston;

wherein the flow diverted includes a first outlet port in fluid communication with a first flow passage formed radially between the distributor sleeve and the tubular casing, and a second outlet port in fluid communication with a second flow passage formed radially between the distributor sleeve and the tubular casing; and a first chamber and a second chamber in the casing, wherein the piston has a first position with the first flow passage in fluid communication with the first chamber and a second position with the second flow passage in fluid communication with the second chamber.

14. The assembly of claim 13 wherein the adjustable choke comprises:

a body having an upper end, a lower end, a counterbore extending axially from the upper end;

wherein the first bypass port extends axially from the counterbore to the lower end;

wherein the counterbore is in fluid communication with the through passage of the fluid conduit and the first bypass port is in fluid communication with the through passage of the piston; and wherein the first bypass port and the counterbore intersect at a seat adapted to receive a plug that restricts fluid flow through the first bypass port.

15. A percussion drilling assembly for boring into the earth, the percussion drilling assembly coupled to the lower end of a drill string and comprising:

a top sub having a through passage in fluid communication with the drill string;

a tubular casing having an upper end coupled to the top sub and a lower end coupled to a drill bit;

a piston slidingly disposed in the casing, wherein the piston includes an upper end, a lower end, and through passage extending therebetween;

a fluid conduit having a central axis and a through passage, wherein the fluid conduit extends from the through passage of the top sub to the through passage of the piston, and includes an adjustable choke that adjustably restricts fluid flow between the though passage of the fluid conduit and the through passage of the piston;

wherein the adjustable choke comprises:

a body having an upper end, a lower end, a counterbore extending axially from the upper end, and a bypass port extending from the counterbore;

at least one aperture extending radially through the body from the counterbore and axially positioned between the upper end and the first bypass port.

16. The assembly of claim 15 wherein the drill bit includes a longitudinal bore in fluid communication with the through passage of the piston and a formation engaging bit face including a nozzle in fluid communication with longitudinal bore, and wherein the fluid conduit includes a check valve that allows one-way fluid communication from the through passage of the top sub to the through passage of the fluid conduit.

17. The assembly of claim 16 further comprising:

a first chamber positioned between the upper end of the piston and the lower end of the top sub;

a second chamber positioned between the lower end of the piston and the drill bit;

wherein the fluid conduit comprises a first outlet port and a second outlet port, wherein each outlet port is in fluid communication with the through passage of the fluid conduit; and wherein the piston has a first position with the first outlet port in fluid communication with the first chamber and a second position with the second outlet port in fluid communication with the second chamber.

18. The assembly of claim 17 wherein the adjustable choke is disposed in the through passage of the fluid conduit, wherein the bypass port extends axially from the counterbore to the lower end;

wherein the counterbore is in fluid communication with the through passage of the fluid conduit and the bypass port is in fluid communication with the through passage of the piston; and wherein the bypass port and the counterbore intersect at a seat adapted to receive a plug that restricts fluid flow through the bypass port.

19. The assembly of claim 18 wherein the adjustable choke has an open configuration with the through passage of the fluid conduit in fluid communication with the through passage of the piston through the bypass port, and a closed configuration with fluid flow through the bypass port restricted by the plug seated in the seat.

20. The assembly of claim 17 wherein the adjustable choke comprises:

a first portion disposed in the through passage of the fluid conduit and a second portion extending from the fluid conduit;

a first bypass port in the lower portion, the first bypass port extending radially from the counterbore to the piston through passage; and a second bypass port in the lower portion axially spaced from the first bypass port, the second bypass port extending radially from the counterbore to the piston through passage.

21. The assembly of claim 20 wherein the counterbore is adapted to receive a first plug and a second plug, wherein the first plug restricts fluid flow through the first bypass port and the second plug restricts fluid flow through the second bypass port.

22. The assembly of claim 21 wherein the adjustable choke further comprises a plurality of arms extending radially from the first portion of the body, each arm having a radially outer surface that engages the inner surface of the fluid conduit and a sloped guide surface adapted to direct a plug into the counterbore.

23. The assembly of claim 22 further comprising a first annulus positioned radially between the body of the adjustable choke and the first and second outlet ports of the fluid conduit, wherein the first annulus is in fluid communication with the through passage of the flow conduit and the first and second outlet ports of the flow conduit.

24. The assembly of claim 23 further comprising a second annulus positioned radially between the lower portion of the adjustable choke body and the piston, wherein the first and the second bypass ports are in fluid communication with the second annulus.

25. The assembly of claim 22 wherein the at least one aperture extends from the counterbore and to the first annulus.

26. The assembly of claim 20 wherein the adjustable choke has an opened configuration with the through passage of the fluid conduit in fluid communication with the through passage of the piston through the first bypass port and through the second bypass port.

27. The assembly of claim 26 wherein the adjustable choke has a partially restricted configuration with a first plug in the counterbore restricting fluid flow through the first bypass port, and the through passage of the fluid conduit in fluid communication with the through passage of the piston through the second bypass port.

28. The assembly of claim 27 wherein the adjustable choke has a closed configuration with the first plug restricting fluid flow through the first bypass port choke and a second plug in the counterbore restricting fluid flow through the second bypass port.

29. A percussion drilling assembly for boring into the earth, the percussion drilling assembly coupled to the lower end of a drill string and comprising:

a top sub having a through passage in fluid communication with the drill string;

a tubular casing having an upper end coupled to the top sub and a lower end coupled to a drill bit;

a piston slidingly disposed in the casing, wherein the piston includes an upper end, a lower end, and through passage extending therebetween;

a fluid conduit having a central axis and a through passage, wherein the fluid conduit extends from the through passage of the top sub to the through passage of the piston, and includes an adjustable choke that adjustably restricts fluid flow between the though passage of the fluid conduit and the through passage of the piston;

wherein the hammer bit includes a longitudinal bore in fluid communication with the through passage of the piston and a formation engaging bit face including a nozzle in fluid communication with longitudinal bore, and wherein the fluid conduit includes a check valve that allows one-way fluid communication from the through passage of the top sub to the through passage of the fluid conduit;

a first chamber positioned between the upper end of the piston and the lower end of the top sub;

a second chamber positioned between the lower end of the piston and the hammer bit;

wherein the fluid conduit comprises a first outlet port and a second outlet port, wherein each outlet port is in fluid communication with the through passage of the fluid conduit; and wherein the piston has a first position with the first outlet port in fluid communication with the first chamber and a second position with the second outlet port in fluid communication with the second chamber;

wherein the adjustable choke is disposed in the through passage of the fluid conduit, wherein the adjustable choke comprises:

a body having an upper end, a lower end, a counterbore extending axially from the upper end, and a bypass port extending axially from the counterbore to the lower end;

a plurality of arms radially extending from the upper end of the body, each arm having a radially outer surface that engages the inner surface of the fluid conduit and a sloped guide surface adapted to guide the plug into the counterbore;

wherein the counterbore is in fluid communication with the through passage of the fluid conduit and the bypass port is in fluid communication with the through passage of the piston; and wherein the bypass port and the counterbore intersect at a seat adapted to receive a plug that restricts fluid flow through the bypass port;

wherein the adjustable choke has an open configuration with the through passage of the fluid conduit in fluid communication with the through passage of the piston through the bypass port, and a closed configuration with fluid flow through the bypass port restricted by the plug seated in the seat.

30. The assembly of claim 29 further comprising an annulus positioned radially between the body of the adjustable choke and the first and second outlet ports of the flow conduit, wherein the annulus is in fluid communication with the through passage of the fluid conduit and in fluid communication with the first and second outlet ports.

31. The assembly of claim 30 wherein the body of the adjustable choke further comprises an elongate aperture extending from the counterbore to the annulus.

32. A method for drilling an earthen borehole, comprising:

disposing a percussion drilling assembly downhole on a drillstring, wherein the percussion drilling assembly comprises:

a tubular casing coupled to the drillstring;

a piston slidingly disposed in the casing;

a first and a second chamber in the casing;

a hammer bit coupled to the casing; and an adjustable choke including a first outlet port and a first bypass port;

flowing a compressed fluid down the drillstring from the surface;

dividing the compressed fluid into a first fraction of compressed fluid having a first volumetric flow rate and that flows to the first and the second chambers, and a second fraction of compressed fluid having a second volumetric flow rate and that bypasses the first and the second chambers;

wherein the first fraction of compressed fluid flows through the first outlet port and the second fraction of compressed fluid flows through the first bypass port;

decreasing the second volumetric flow rate downhole; and increasing the first volumetric flow rate simultaneous with decreasing the second volumetric flow rate.

33. The method of claim 32 further comprising:

actuating the piston with the first fraction of compressed fluid;

flushing formation cuttings from a formation engaging face of the hammer bit with the second fraction of compressed fluid.

34. The method of claim 33 wherein flowing a compressed fluid down the drillstring comprises flowing a substantially constant volumetric flow rate of compressed fluid down the drillstring.

35. The method of claim 33 wherein the adjustable choke further includes a second outlet port and a second bypass port, wherein the first fraction of compressed fluid flows through the first and second outlet ports and the second fraction of compressed fluid flows through the first and the second bypass ports.

36. The method of claim 35 further comprising progressively restricting the flow of the second fraction of compressed fluid through the first bypass port and the second bypass port.

37. The method of claim 36 further comprising restricting the flow of the second fraction of compressed fluid through the first bypass port.

38. The method of claim 36 further comprising restricting the flow of the second fraction of compressed fluid through the second bypass port.

39. The method of claim 36 wherein the flow through the first and the second bypass port is restricted by a first and a second plug respectively.

40. A method for drilling an earthen borehole, comprising:

disposing a percussion drilling assembly downhole on a drillstring, wherein the percussion drilling assembly comprises:

a tubular casing coupled to the drillstring;

a piston slidingly disposed in the casing;

a first and a second chamber in the casing; and a hammer bit coupled to the casing;

flowing a compressed fluid down the drillstring from the surface;

dividing the compressed fluid into a first fraction of compressed fluid having a first volumetric flow rate and that flows to the first and the second chambers, and a second fraction of compressed fluid having a second volumetric flow rate and that bypasses the first and the second chambers;

decreasing the second volumetric flow rate; and increasing the first volumetric flow rate simultaneous with decreasing the second volumetric flow rate;

actuating the piston with the first fraction of compressed fluid;

flushing formation cuttings from a formation engaging face of the hammer bit with the second fraction of compressed fluid;

wherein the percussion drilling assembly further comprises an adjustable choke including a first outlet port, a second outlet port, and a bypass port, wherein the first fraction of compressed fluid flows through the first and second outlet ports and the second fraction of compressed fluid flows through the bypass port.

41. The method of claim 40 further comprising restricting the flow of the second fraction of compressed fluid through the bypass port.

42. The method of claim 41 wherein restricting the flow of the second fraction of compressed fluid comprising placing a plug in the flow of compressed fluid from the surface.

* * * * *